US012534961B2

(12) United States Patent
Trunk et al.

(10) Patent No.: US 12,534,961 B2
(45) Date of Patent: Jan. 27, 2026

(54) BRAKE AND WEAR INDICATOR FOR EXPANDABLE DOWNHOLE TOOL

(71) Applicant: Schlumberger Technology Corporation, Sugar Land, TX (US)

(72) Inventors: Philip Trunk, Houston, TX (US); Balasubramanian Durairajan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/413,703

(22) Filed: Jan. 16, 2024

(65) Prior Publication Data

US 2025/0230714 A1 Jul. 17, 2025

(51) Int. Cl.

| | |
|---|---|
| ***E21B 12/02*** | (2006.01) |
| ***E21B 10/32*** | (2006.01) |
| ***E21B 44/00*** | (2006.01) |
| ***E21B 45/00*** | (2006.01) |

(52) U.S. Cl.

CPC ..... *E21B 12/02* (2013.01); *E21B 10/32* (2013.01); *E21B 44/00* (2013.01); *E21B 45/00* (2013.01)

(58) Field of Classification Search

CPC ..... E21B 12/02; E21B 10/32; E21B 44/00; E21B 45/00

See application file for complete search history.

(56) References Cited

U.S. PATENT DOCUMENTS 12,116,845 B2 10/2024 Trunk
2009/0055135 A1* 2/2009 Tang ..... G06F 30/17 703/7
2009/0294173 A1 12/2009 Laird
2011/0166837 A1* 7/2011 Servaes ..... E21B 10/26 703/2
2013/0256036 A1* 10/2013 Lyons ..... E21B 10/322 175/428
2014/0182934 A1 7/2014 Samuel
2015/0322767 A1 11/2015 Samuel
2018/0051548 A1 2/2018 Liu
2018/0163480 A1 6/2018 Evans
2019/0055786 A1* 2/2019 Trunk ..... E21B 10/567
2019/0106943 A1* 4/2019 Tilleman ..... E21B 10/5673
2019/0292897 A1 9/2019 Costa De Oliveira
2024/0242326 A1 7/2024 Chowhan
2025/0230741 A1 7/2025 Trunk

OTHER PUBLICATIONS

Liu, Y. et al., "Real-Time Detection of Under-Reamer Failure: An Example of Agile Data Analytics Development and Deployment", SNAME-TOS-2018-020, presented at the SNAME 23rd Offshore Symposium, Houston, Texas, USA, 2018, 6 pages.

* cited by examiner

*Primary Examiner* — Caroline N Butcher
(74) *Attorney, Agent, or Firm* — Jeffrey D. Frantz

(57) ABSTRACT

An expandable tool includes a reamer block, a cutting element coupled to the reamer block, and a brake element embedded in the reamer block. The cutting element includes a cutting face extending to a gauge radius of the reamer block. The cutting element has a cutting rake angle formed on a radial plane between the cutting face and a normal line orthogonal to a borehole wall. The brake element includes an engagement face extending less than the cutting diameter. The brake element has a brake rake angle that is different than the cutting rake angle, such as by at least 45°. The brake rake angle is defined between the engagement face and the normal line.

11 Claims, 12 Drawing Sheets

BRAKE AND WEAR INDICATOR FOR EXPANDABLE DOWNHOLE TOOL

CROSS-REFERENCE TO RELATED APPLICATIONS

N/A.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled. In some situations, an expandable downhole tool may expand the diameter of the wellbore, cut a portion of the casing, or perform any other cutting activity. Some downhole tools may include cutter blocks that may be selectively expanded.

In some situations, an expandable downhole tool may experience wear which may result in a reduced diameter of the expandable downhole tool. This may cause the expandable downhole tool to be ineffective at expanding the diameter of the wellbore. It may be difficult to know when the expandable downhole tool experiences wear. As a result, a drilling operation may employ an ineffective expandable downhole tool for a significant and costly amount of time before taking mitigating measures. Due to the difficulty in detecting wear, it may also be difficult to know at what location or depth the expandable downhole tool became ineffective, and what corresponding portion of the borehole is deficient. This may become costly and burdensome to the drilling operation. For this purpose, it may be advantageous to detect wear of an expandable downhole tool.

SUMMARY

In some embodiments, an expandable tool includes a reamer block, a cutting element coupled to the reamer block, and a brake element embedded in the reamer block. The cutting element includes a cutting face extending to a gauge radius of the reamer block. The cutting element has a cutting rake angle formed on a radial plane between the cutting face and a normal line orthogonal to a borehole wall. The brake element includes an engagement face extending less than the cutting diameter. The brake element has a brake rake angle that is different than the cutting rake angle by at least 45°. The brake rake angle is defined between the engagement face and the normal line.

In some embodiments, a drilling system includes a processing unit configured to determine when a brake element engages a formation and a bottom hole assembly (BHA) having an expandable reamer. The expandable reamer includes a plurality of expandable blocks positioned radially around the expandable reamer. At least one of the reamer blocks includes a plurality of cutting elements coupled to the at least one expandable block, and the cutting elements define a cutting profile. The expandable block includes the brake element embedded in the expandable block. The brake element radially extends less than the cutting profile.

In some embodiments, a method of operating a drilling system includes receiving drilling parameters while performing a drilling operation with an expandable reamer and a bit. The method also includes determining that a brake element of the expandable reamer has engaged a borehole wall, and adjusting the drilling operation based on determining that the brake element has engaged the borehole wall. The received drilling parameters include one or more of a weight on the expandable reamer (WOR), a torque on the expandable reamer (TOR), and a rate of penetration (ROP. The engagement of the brake element with the borehole wall is determined based on comparison of the drilling parameters to one or more thresholds.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a perspective view of an expandable tool, according to at least one embodiment of the present disclosure;

FIG. 2-2 is a perspective view of an expandable block, according to at least one embodiment of the present disclosure;

FIG. 2-3 is a side cross-sectional view of the expandable block of FIG. 2-2;

FIG. 2-4 is a top-down cross-sectional view of the expandable block of FIG. 2-2;

FIG. 2-5 is a front cross-sectional view of the expandable block of FIG. 2-2;

FIG. 3-1 is a top-down cross-sectional diagram of an expandable block, according to at least one embodiment of the present disclosure;

FIG. 3-2 is a side cross-sectional diagram of an expandable block, according to at least one embodiment of the present disclosure;

FIG. 4-1 is an exploded perspective view of an expandable block, according to at least one embodiment of the present disclosure;

FIGS. 4-2 to 4-4 are exploded bottom views of the expandable block of FIG. 4-1;

FIG. 4-5 is a top-down cross-sectional diagram of an expandable block, according to at least one embodiment of the present disclosure;

FIG. 4-6 is a top-down cross-sectional diagram of an expandable block, according to at least one embodiment of the present disclosure;

FIG. 4-7 is a side cross-sectional diagram of an expandable block, according to at least one embodiment of the present disclosure; and FIG. 5 is a flowchart of a method of using an expandable tool, according to at least one embodiment of the present disclosure.

DETAILED DESCRIPTION

This disclosure generally relates to devices, systems, and methods for detecting wear of expandable downhole tools. The expandable tool may include an expandable block set having one or more expandable blocks. For example, the expandable tool may be an expandable reamer and may include one or more reamer blocks. The expandable reamer may include a tool body having one or more expandable reamer blades. The expandable blades of the tool body may include one or more cutting elements for widening a borehole to a gauge diameter. At least one of the expandable blades may include a brake element. The brake element may be embedded in the expandable blade less than a profile radius of the one or more cutting elements, or less than the gauge diameter. In this manner, the brake element may not engage the borehole until the expandable blade has reached a threshold level of wear, or until the tool body of the expandable reamer has an extended diameter that is less than the gauge diameter at the brake element. This may indicate that the tool body is at risk of ringout, or at risk of wearing to a reduced diameter along a length of the tool body, thereby reducing the diameter at which the reamer is cutting the borehole wall.

In accordance with at least one embodiment of the present disclosure, the brake element may allow a drilling operator located at the surface to detect that the expandable reamer has worn to less than the gauge diameter at the location of the brake element. This may indicate that the expandable reamer is at a risk of experiencing ringout and/or has experienced ringout. When the brake element engages the borehole wall and/or a ledge in the borehole, it may not efficiently cut the borehole wall and/or may prohibit efficient movement of the expandable reamer down the borehole. For example, the brake element may be oriented with a different rake angle and/or profile angle than the cutting elements of the expandable blade. This may result in a reduction in torque on the reamer ("TOR"), an increase in weight on the reamer ("WOR"), a decrease in rate of penetration ("ROP") of a downhole system, and combinations thereof. In this manner, by observing one or more of these changes in operation of the expandable tool, a drilling operator may detect that the expandable downhole tool is worn below the threshold level of wear.

Figure 1:
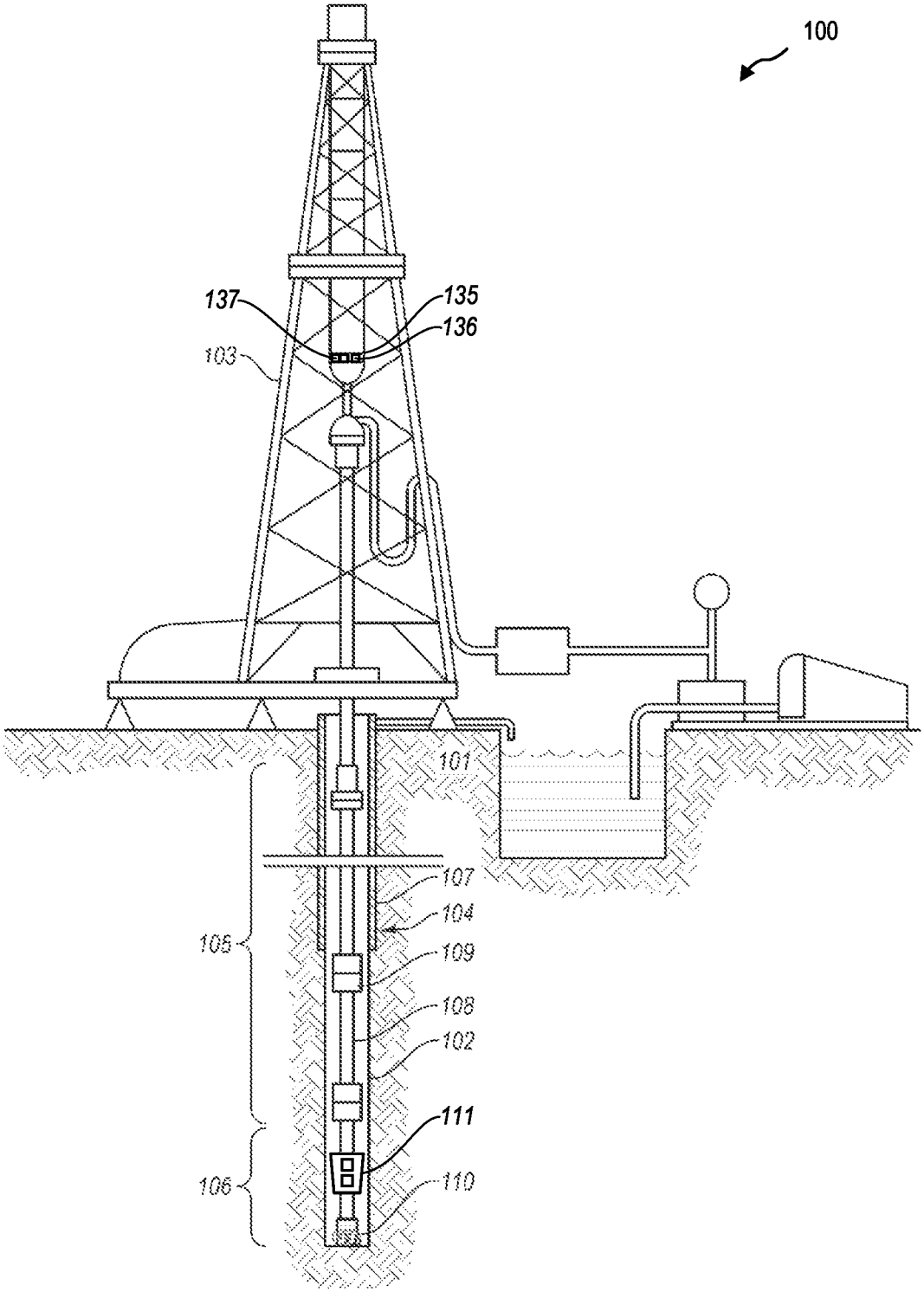
FIG. 1 is an example of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105. The drill rig 103 may include any type of drill rig. For example, the drill rig 103 may include a top drive. A top drive drill rig may include a rotary table and a hook. The hook may support the drill string 105 and lower the drill string 105 into the wellbore 102. The rotary table may rotate the drill string 105, including the elements of the drilling tool assembly 104, such as an expandable tool 111 and/or the bit 110.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The expandable tool 111 may be coupled to the BHA 106. The expandable tool 111 may be any type of expandable tool, such as an expandable reamer, an expandable stabilizer, and expandable casing cutter, any other expandable tool, and combinations thereof. In some embodiments, multiple expandable tools 111 may be coupled to the BHA 106. In some embodiments, a single expandable tool 111 may be coupled to the BHA 106.

The expandable tool 111 may include an expandable block set having one or more expandable blocks. For example, the expandable tool 111 may be an expandable reamer having one or more reamer blocks. The expandable blocks may include one or more formation-engaging elements. For example, an expandable reamer block may include one or more cutting elements configured to degrade the formation to expand the diameter of the wellbore. In some examples, an expandable casing cutter may include one or more cutting elements configured to cut and remove a portion of a casing. In some examples, an expandable stabilizer block may include one or more wear elements configured to engage the formation and stabilize the BHA 106 and/or the drill string. At least one of the expandable blocks from the expandable block set may include one or more brake elements.

In some situations, as the expandable tool 111 engages the earth formation 101, one or more segments of the expandable block set may wear or break away from the expandable block set. This may result in the expandable tool 111 no longer being effective at cutting the earth formation 101. For example, the expandable tool 111 may no longer be able to effectively widen the borehole to a desired diameter, such as a gauge diameter.

During drilling activities, the bit 110 may experience a weight on bit ("WOB"). The WOB may be adjusted by the drilling system 100, by, for example, adjusting the amount of the weight of the drilling tool assembly 104 that is supported by the drill rig 103. The WOB may be measured at any location. For example, the WOB may be measured at a downhole location to determine a downhole WOB ("DWOB"), such as using sensors at the bit 110 and/or the BHA 106. In some embodiments, the WOB may be measured or received at a surface location to determine a surface WOB ("SWOB"). The SWOB may be the measured weight of the entire drill string, BHA 106, and other downhole tools suspended from the surface. As used herein and unless explicitly stated otherwise, the WOB may refer to the DWOB, the SWOB, or both the DWOB and the SWOB.

During drilling operations, the drilling system 100 may apply a torque on bit ("TOB") to the drilling tool assembly 104, which may result in a rotation having a rotation per minute ("RPM") to the drilling tool assembly 104. The TOB may be measured or received at any location. For example, the TOB may be measured or received at a downhole location to determine a downhole TOB ("DTOB"), such as using sensors at the bit 110 and/or the BHA 106. In some embodiments, the TOB may be measured at a surface location to determine a surface TOB ("STOB"). The STOB may be the measured weight of the entire drill string, BHA 106, and other downhole tools suspended from the surface. As used herein and unless explicitly stated otherwise, the TOB may refer to the DTOB, the STOB, or both the DTOB and the STOB.

The drilling system 100 may include a SWOB sensor 136 for determining the SWOB as measured at a surface location (such as a sensor on the hook), a ROP sensor 137 for determining the ROP as measured at the surface location (such as by determining the rate at which the drill string 105 is lowered into the wellbore 102), and a STOB sensor 135 for measuring the STOB at a surface location such as at the collar (such as a torque sensor on the rotary table). In some embodiments, the SWOB sensor 136, the STOB sensor 135, and/or the ROP sensor 137 may be in communication with a processing unit for processing and/or analyzing data observed by the sensors (e.g., the processing unit may receive drilling parameters from one or more sensors). In some embodiments, the processing unit may be located at the surface location. In some embodiments, the processing unit may be located on the BHA 106 downhole.

In some situations, the WOR may be approximately 10% of the SWOB and/or the TOR may be 10% of the STOB. Because the WOR and/or TOR may vary based on downhole drilling conditions, variations in the WOR may be difficult to detect based on the measured WOB. For example, a reduction in WOR (resulting from ringout of a conventional expandable reamer) may result in a reduction in the total SWOB of approximately 10%. This reduction of the SWOB may be difficult to detect outside of the noise or variability of the SWOB during a drilling operation. In some examples, a change in TOR (resulting from ringout of a conventional expandable reamer) may result in a change in the STOB of approximately 10%. This change in the STOB may be difficult to detect outside of the noise or variability of the STOB during a drilling operation.

In accordance with at least one embodiment of the present disclosure, wear on the expandable block may expose one or more brake elements located on (e.g., embedded within) the expandable block. The brake elements may be oriented such that they are inefficient at cutting the earth formation 101, resulting in observable changes in the operation of the drilling system 100. For example, the brake elements may be oriented to generate an increase in the WOR that is detectable from the surface. For example, the brake elements may be oriented to generate an increase in the WOR that is detectable when compared to the noise or variability of the SWOB (e.g., greater than the noise). In this manner, when the SWOB sensor 136 detects that the SWOB has increased, the drilling operator may determine that the increase in the SWOB is a result of an increase in WOR. This may allow the drilling operator to determine whether the expandable tool 111 has experienced ringout. In some embodiments, the brake elements may be oriented to generate a change in the TOR that is detectable when compared to the noise or variability of the total STOB (e.g., greater than the noise). In this manner, when the STOB sensor 135 detects that the STOB has changed as measured at the surface location, the drilling operator may determine that the change in STOB is due to a change in TOR caused by ringout. In some embodiments, the brake elements may be oriented to generate a reduction in the ROP that is detectable when compared to the noise or variability of the total ROP (e.g., greater than the noise). In this manner, when the ROP sensor 137 detects that the ROP has changed as measured at the surface location, the drilling operator may determine that the change in ROP is due to a change in ROP caused by ringout.

In some embodiments, the processing unit may receive the measurements (e.g., drilling parameters) from the SWOB sensor 136, STOB sensor 135, and/or the ROP sensor 137 and may determine whether a change in SWOB, STOB, and/or ROP is noise, or variation in the measured values, or whether the change is based on the brake element contacting the wellbore wall. For example, the processing unit may compare the measurements to one or more thresholds in order to determine whether the observed drilling parameters correspond to the brake element contacting the wellbore wall. In another example, the processing unit may analyze the patterns of the noise or variation in the surface drilling parameters (e.g., compare the observed drilling parameters to ordinary or expected patterns of noise). If the processing unit determines that a change in the surface drilling parameters is outside of the normal variation or noise, then the processing unit may determine that the change is due to the brake element contacting the wellbore wall. The processing unit may automatically adjust one or more drilling parameters based on this determination. In some embodiments, the processing unit may communicate the determination of the brake element contacting the wellbore wall to a drilling operator.

The drilling system 100 may determine a depth of BHA 106 (including the bit 110 and/or the expandable tool 111) during a drilling operation. In some embodiments, the depth of the wellbore may be known and/or inferred based on the number of drill pipes and other downhole tools inserted into the wellbore. In some embodiments, the BHA may include one or more survey tools that may determine a depth of one or more downhole tools, such as the expandable tool 111 and/or the bit 110. The drilling system 100 may associate the depth of the change in WOB, TOB, or ROP. This may allow the drilling operator to determine where the ringout occurred, thereby allowing the drilling operator to mitigate the ringout at the location it occurred.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
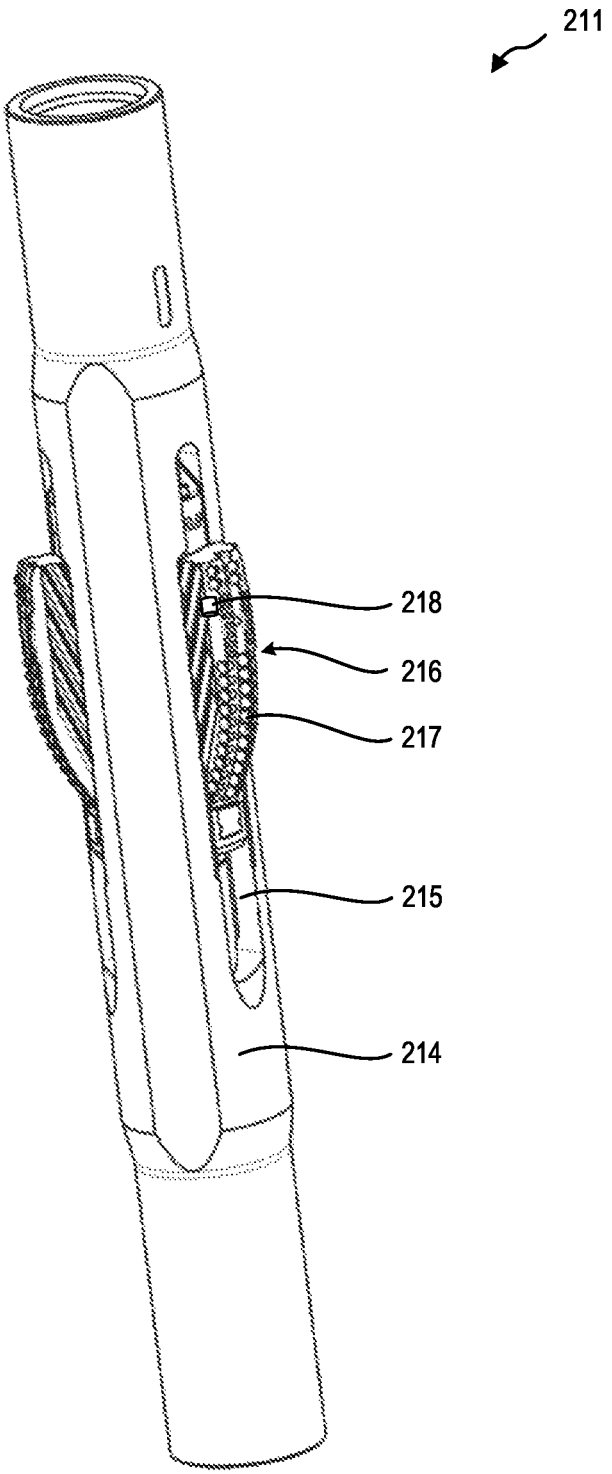
Figure 2:
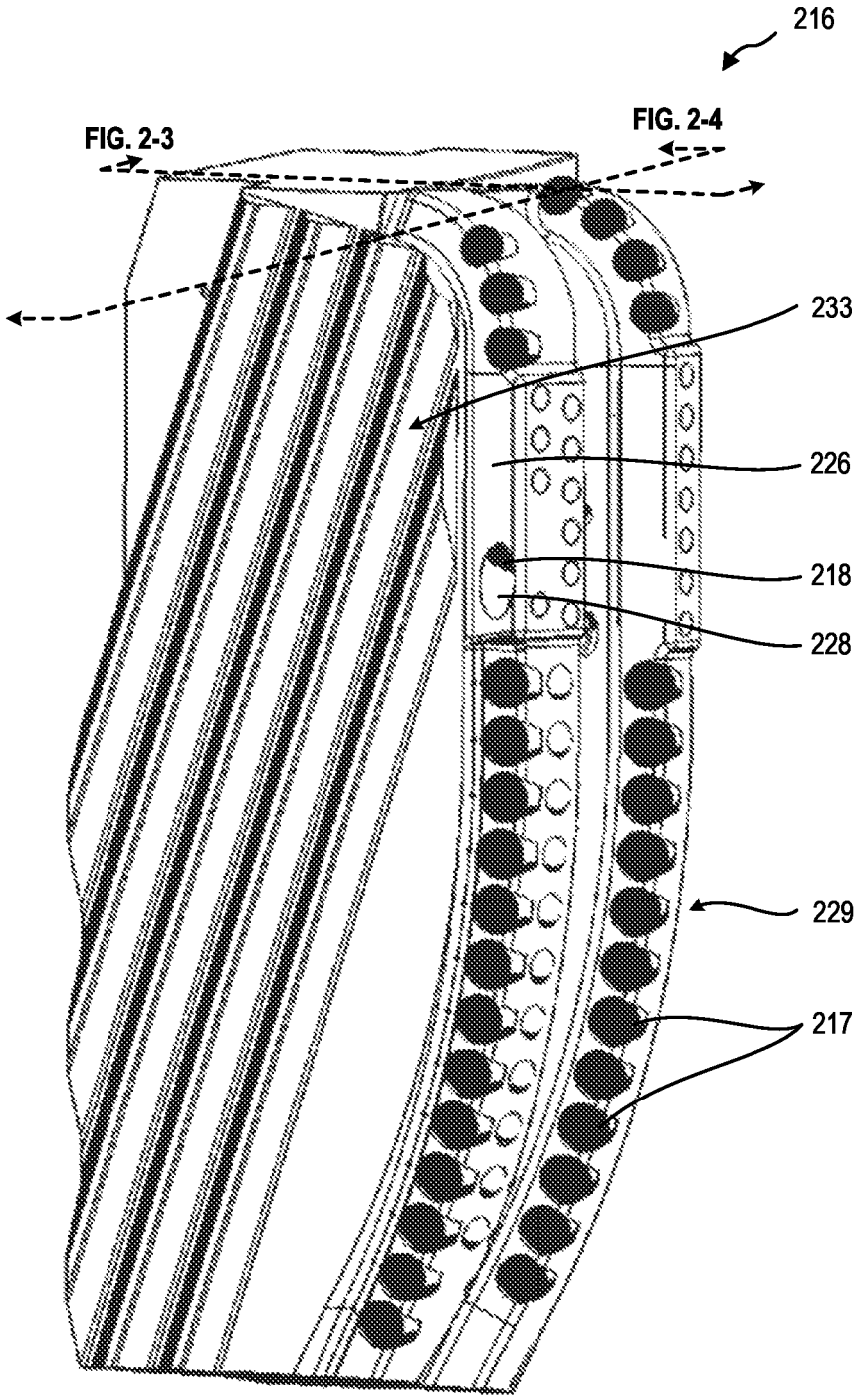

FIG. 2-1 is a perspective view of an expandable tool 211, according to at least one embodiment of the present disclosure. The expandable tool 211 may be coupled to a BHA, drill rig, or other element of a downhole drilling assembly. The expandable tool 211 includes a housing 214. The housing 214 includes a plurality of openings 215 and a plurality of expandable blocks 216. At each opening 215, an expandable block 216 is disposed inside of the housing 214. In some embodiments, the expandable block 216 may be a reamer block. In the expanded configuration shown, the expandable blocks 216 extend out of the housing 214 through the openings 215. In the retracted configuration, the expandable blocks 216 are retracted into the housing 214 and may not extend out of the openings 215, or extend out of the openings 215 less than in the expanded configuration. In the embodiment shown, the expandable tool 211 is an expandable reamer and the expandable block 216 is a reamer block that includes a plurality of cutting elements 217. But it should be understood that the expandable tool 211 may be any type of expandable tool, such as an expandable reamer, an expandable casing cutter, an expandable stabilizer, any other type of expandable tool, and combinations thereof. The expandable block 216 may be any type of expandable block 216, such as an expandable reamer block, an expandable casing cutter block, an expandable stabilizer block, any other type of expandable block, and combinations thereof. While embodiments of the present disclosure may be described with respect to an expandable reamer, it should be understood that such description may be applied to any other type of expandable tool.

In downhole drilling operations, a reamer or other cutting tool may be used to increase the diameter of a wellbore. In some situations, a reamer may be located on the same BHA (e.g., BHA 106 of FIG. 1) as a bit. In this manner, as the bit erodes a formation with a bit diameter, the reamer may follow the bit and erode the formation with a reamer diameter or gauge diameter. This may allow for larger wellbores to be drilled in a single pass or trip downhole. In other words, the wellbore may be reamed while the pilot hole is being drilled. In some situations, a reamer may be tripped into an existing wellbore to increase the diameter of the existing wellbore in a different pass or trip than the bit. Put another way, a pilot hole may be drilled before the reamer is inserted into the wellbore.

The expandable block 216 may include a brake element 218 embedded in the body of the expandable block 216. As the expandable block 216 and cutting elements 217 wear, a cutting diameter of the expandable tool 211 may become reduced, and the brake element 218 may become exposed to the wellbore wall. The brake element 218 may contact the wellbore wall and change the WOR and/or TOR enough to be noticed by the surface equipment as a change in the WOB and/or TOB.

FIG. 2-2 is a perspective view of the expandable block 216 of FIG. 2-1. The expandable block 216 may include a plurality of cutting elements 217. The plurality of cutting elements 217 may be positioned along a periphery of the expandable block 216 and may define a cutting profile 229. The cutting profile 229 may be curved radially inward at a lower portion, and an upper portion may extend radially outward farther than the lower portion. In other words, the upper portion of the cutting profile 229 may extend a first cutting profile radius and the lower portion of the cutting profile 229 may extend a second cutting profile radius less than the first cutting profile radius. In this way, the cutting profile 229 may define a roughly conical surface when rotated about the axis of the expandable tool. This may allow expandable tool to expand the diameter of the wellbore to a gauge diameter of the expandable tool.

During downhole drilling operations, as the expandable block 216 engages with the earth formation or borehole, the expandable block 216 may experience wear. For example, the plurality of cutting elements 217 and/or the body of the expandable block 216 may chip, spall, or otherwise break. In some instances, one or more of the cutting elements 217 may be removed from the expandable tool 211. In some circumstances, one or more of the cutting elements 217 and/or a periphery of the expandable block 216 may wear down such that the expandable tool 211 experiences ringout, or a reduced diameter. This may reduce the effectiveness of the expandable tool 211. A reduced diameter may result in the expandable tool no longer being able to expand the borehole to the gauge diameter. This can result in delays to a downhole operation and increased costs. For example, ringout of an expandable tool 211 may cause a drilling operation to be stopped and the expandable tool 211 tripped out of the borehole (e.g., pulled out of hole (POOH)) for repair and/or replacement. In some situations, as discussed herein, ringout of a conventional expandable reamer may be undetected because the change in WOB, TOB, or ROP as detected at a surface location may not noticeably change. The drilling operator may not know where to begin re-reaming the wellbore, which may result in further delays and/or sections of the wellbore that were not expanded to the gauge diameter.

In accordance with at least one embodiment of the present disclosure, the expandable block 216 may include a brake element 218. The brake element 218 may be configured such that it engages the borehole wall once the expandable block 216 has worn below a threshold level of wear. For example, the brake element 218 may engage the borehole wall when the expandable block 216 has reached a threshold level of wear corresponding to ringout of the expandable tool 211.

When the brake element 218 engages the borehole wall, a drilling operator at the surface may observe a change in behavior of the drilling system. For example, the brake element 218 may engage the borehole wall and cause a change in TOR. The brake element 218 may engage the borehole wall and cause a change in WOR. The brake element 218 may engage the borehole wall and cause a change in the ROP of a downhole bit and/or a reamer (e.g., a "system ROP"). In some embodiments, two or more changes in drilling behavior may occur simultaneously. For example, the brake element 218 may engage the borehole wall and cause a change in the TOR and a change in WOR. In some examples, the brake element 218 may engage the borehole wall and cause a change in WOR and a change in ROP. As discussed herein, these changes in behavior of the drilling system may be large enough to detect at the surface, and may indicate to the operator that the expandable tool 211 is experiencing ringout.

Detection of changes to the drilling system behavior may be part of a ringout sensing system implemented in the drilling system. These detections may also be part of a monitoring of routine parameters of the drilling system. In this way, an operator at the surface of the borehole may detect the changes in behavior of the drilling system and determine that the expandable tool 211 has experienced ringout.

The brake element 218 engaging with the borehole wall may cause a change in behavior of the drilling system that corresponds to a location in the borehole, or a depth of the expandable tool 211. This may allow a drill operator to be able to identify a depth where the expandable tool 211 experienced ringout or was at risk of developing ringout, resulting in a reduced diameter of the borehole. This may allow the operator of a drilling system to quickly and effectively take a mitigating action in response to the expandable tool 211 being worn out. In other words, an operator may change one or more drilling parameters of the drilling system in response to the brake element 218 engaging the borehole wall. For example, an operator may elect to increase or decrease the SWOB, the RPM of the drilling tool assembly, the STOB, change any other drilling parameter, and combinations thereof.

In some embodiments, after detecting ringout, a drilling operator may deactivate or stop operation of the expandable tool 211. For example, the drilling operator may retract the expandable block 216 to a retracted position. In some embodiments, the drilling operator may activate a separate downhole tool in response to detecting the brake element 218 engaging the borehole wall. For example, the BHA may include multiple expandable tools 211, and the drilling operator may activate a second expandable tool after detecting the brake element 218 from a first expandable tool engaging the borehole wall. In some embodiments, an operator may trip the drilling tool assembly from the borehole in order to repair or replace the expandable tool 211. In some embodiments, the operator may continue operation of the drilling system and of the expandable tool 211 without changing any drilling parameters of the drilling system. In this way, an operation of the drilling system may be changed based on an indication of the brake element 218 that the expandable tool 211 has experienced ringout.

In accordance with at least one embodiment of the present disclosure, the brake element 218 may be oriented in a passive orientation. A passive orientation may be an orientation that is not intended to be the same as one of the cutting elements 217. For example, the brake element 218 may be oriented such that it is does not cut rock effectively. In some examples, the brake element 218 may be oriented such that it uses more force to degrade the formation than the cutting elements 217.

In some embodiments, the passive orientation of the brake element 218 may cause the TOB to decrease when the brake element 218 engages the wellbore wall. The change in TOB (e.g., STOB, DTOB) may be greater than a typical level of variation or noise observed by torque sensors at the surface. For example, this may result in the change in TOR (and therefore the detected TOB) that is distinguishable from the noise of torque variation. In some embodiments, the passive orientation of the brake element 218 may result in a decrease in the TOB. In some embodiments, the passive orientation of the brake element 218 may result in an increase in the TOB. Such a change in the TOB past a normal level of variation or noise may alert an operator at the surface that the expandable tool 211 is experiencing ringout.

In some embodiments, the passive orientation of the brake element 218 may cause the WOR (and therefore the SWOB and/or DWOB) to increase when the brake element 218 engages the borehole wall. The increase of the WOB may be greater than a typical level of variation or noise observed by weight sensors at the surface. Such an increase in the WOB past a normal level of variation or noise may indicate to an operator at the surface that the expandable tool 211 is experiencing ringout.

In some embodiments, the passive orientation of the brake element 218 may be such that when the brake element 218 engages the borehole wall, the system ROP. The decrease in ROP may be greater than a typical level of variation or noise observed by ROP sensors such that the decrease is measurable and readily identifiable or distinguishable from the noise. Such a decrease in the ROP past a normal level of variation or noise may indicate to an operator at the surface that the expandable tool 211 is experiencing ringout.

In some embodiments, the expandable block 216 may include multiple brake elements 218. In some embodiments, two or more brake elements 218 may be located at the same longitudinal location and/or at the same profile radius on the body of the expandable block 216. This may correspond to the two or more brake elements engaging the borehole wall at substantially the same time, or after substantially the same amount of wear of the expandable block 216. This may help to increase the signal to the surface when the brake elements 218 engage the surface.

In some embodiments, different brake elements 218 may be located at different longitudinal locations along the expandable block 216. For example, a first portion of the plurality of brake elements 218 may be located at a first longitudinal location along the expandable block 216 and a second portion of the plurality of the brake element 218 may be located at a second longitudinal location along the expandable block 216. The first longitudinal location may correspond to a first portion of the expandable block 216 or a first portion of the cutting profile 229, and the second longitudinal location may correspond to a second portion of the expandable block 216 or a second portion of the cutting profile 229. In other words, the second longitudinal location may be positioned a longitudinal distance from the first longitudinal location. The first longitudinal location may be downhole of the second longitudinal location. In this way, the first portion of the plurality of the brake element 218 may engage the borehole wall and indicate wear of the first portion of the expandable block 216 or wear of the first portion of the cutting profile 229, and the second portion of the plurality of the cutting element 217 may engage the borehole wall and indicate wear of the second portion of the expandable block 216 or wear of the second portion of the cutting profile 229.

In some embodiments, different brake elements of a plurality of the brake elements 218 may be located at different radial locations along the expandable block 216. For example, a first portion of the plurality of the brake element 218 may be connected to the expandable block 216 and extend to a first brake radius, and a second portion of the plurality of the brake element 218 may be connected to the expandable block 216 and extend to a second brake radius. The first brake radius may correspond to a first diameter or a first level of ringout of the expandable block 216, and the second brake radius may correspond to a second diameter or a second level of ringout of the expandable block 216. In this way, the first portion of the plurality of the brake element 218 may engage the borehole wall and indicate ringout or wear of the expandable block 216 to the first diameter, and the second portion of the plurality of the brake element 218 may engage the borehole wall and indicate ringout or wear of the expandable block 216 to the second diameter. In this way, the expandable block 216 may include a plurality of the brake element 218, and at least some of the plurality of the brake element 218 may be positioned in different longitudinal and/or radial locations corresponding to the different brake elements engaging the borehole wall and indicating different forms or levels of wear of the geometry of the expandable block 216.

The brake element 218 may be located radially inward from the cutting profile 229 of the expandable block 216. In some embodiments, the brake element 218 may not engage the borehole wall while the cutting elements 217 radially outward from the brake element 218 are engaging the borehole wall. In some embodiments, the brake element 218 may be positioned such that it does not engage the borehole wall while the expandable tool 211 is still effectively expanding the borehole. For example, the brake element 218 may be positioned such that it engages the borehole wall once the expandable block 216 has worn to a first reduced diameter. In this way, the brake element 218 may be positioned to engage the borehole wall when the expandable block 216 has worn to the first reduced diameter, indicating that the expandable block 216 is no longer widening the borehole to the gauge diameter or is at a risk to no longer widen the borehole to the gauge diameter. In another example, a second brake element 218 may be positioned to engage the borehole wall once the expandable block 216 has been worn to a second reduced diameter less than the first reduced diameter. In this way, the brake element 218 may be positioned to engage the borehole wall when the expandable block 216 has been worn to the second reduced diameter, indicating that the expandable block 216 has undergone a more advanced degree of ringout or wear at the location of the brake element 218.

In some embodiments, the body of the expandable block 216 may protect the brake element 218 from exposure or damage until the brake element 218 engages the borehole wall. For example, the brake element 218 may be embedded in the body of the expandable block 216 such that the brake element 218 does not extend past an outer surface 226 of the expandable block 216. In some embodiments, the brake element may be completely enclosed within the expandable block 216 such that no part of the brake element 218 is outwardly visible and/or accessible. In some embodiments, as shown in FIG. 2-2, the expandable block 216 may include an opening or cavity 228. The brake element 218 may be inserted into the cavity 228 such that the brake element 218 is at least partially outwardly visible. For example, during manufacturing, the cavity 228 may be drilled into the expandable block 216, the brake element 218 may be deposited therein, and connected to the expandable block 216. This may also allow for the retrofitting of existing downhole tools to include the cavity 228 and incorporate the brake element 218.

Covering the brake element 218 with the body of the expandable block 216 may protect it from contact with rock, mud, fragments or pieces of broken drilling equipment, particulates from the earth formation, etc. that may damage the brake element 218 before the expandable block 216 has worn down, exposing the brake element 218. In some embodiments, the brake element 218 may be embedded in the body of the expandable block 216 such that a portion of the brake element 218 does extend at least partially outward past the outer surface 226 of the expandable block 216.

Figures 2, 3:
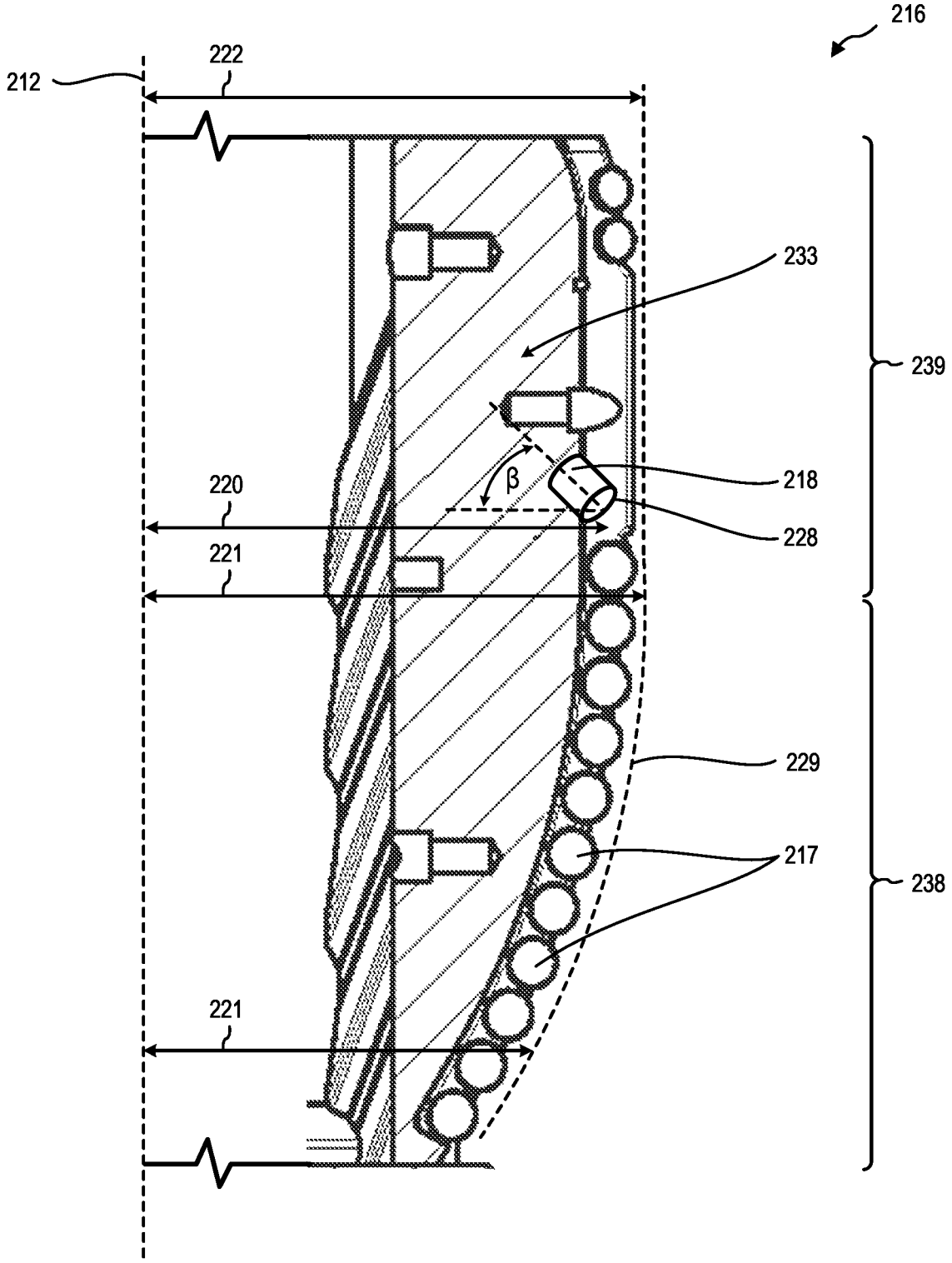

FIG. 2-3 is a side cross-sectional view of the expandable block 216 of FIG. 2-1. The expandable block 216 may rotate around an axis of rotation 212 of the expandable tool 211. The brake element 218 may be embedded in the body 233 of the expandable block 216 and may be positioned at a brake radius 220. The brake radius 220 may be the furthest extent of the brake element 218 from the axis of rotation 212. A profile radius 221 may be the radial distance of the cutting profile 229 corresponding to a longitudinal location of the brake element 218. In other words, the profile radius 221 may vary depending on a longitudinal location of the brake element 218. For example, as shown in FIG. 2-3, the brake element 218 is located longitudinally at a gauge portion 239 of the cutting profile 229. The gauge portion 239 may correspond to a portion of the cutting profile 229 where the profile radius 221 extends to the gauge diameter of the expandable tool 211. In another example, the brake element 218 may be located longitudinally at a nose portion 238 of the cutting profile 229. The nose portion 238 may correspond to a portion of the cutting profile 229 where the profile radius 221 extends less than the profile radius 221 of the gauge portion 239 or less than the gauge diameter of the expandable tool 211. The profile radius 221 of the nose portion may taper toward the axis of rotation 212 as the cutting profile 229 extends longitudinally down the expandable block 216. In other words, the nose portion 238 may extend radially inward toward the axis of rotation 212.

The brake radius 220 may be less than the profile radius 221. In other words, the brake element 218 may be located radially inward from the cutting elements 217 that correspond to the longitudinal location of the brake element 218 along the expandable block 216. In this manner, the brake element 218 may be radially positioned such that it is not initially exposed to the borehole wall when the expandable tool 211 is being used to widen the borehole, and when the cutting elements 217 are engaging the borehole wall. As discussed herein the brake element 218 is embedded within the expandable block 216 such that the brake element 218 is radially within the profile of one or more cutting elements 217 of the expandable block 216. The brake element 218 may become exposed to and engage the borehole wall when the expandable block 216 experiences a level of wear. In this way the brake element 218 engaging the borehole wall may correspond to ringout of the expandable tool 211.

A gauge radius 222 of the expandable tool 211 may correspond to a maximum radial distance of the profile radius 221 of the cutting profile 229. The gauge radius 222 may also correspond to a desired diameter, or gauge diameter of the borehole. In some embodiments, the brake radius 220 may be less than a gauge radius 222 of the expandable tool 211 by a ringout distance. In some embodiments, the ringout distance may be in a range having an upper value, a lower value, or upper and lower values including any of 5 mm, 1 cm, 2 cm, 3 cm, 4 cm, 5 cm, 6 cm, 8 cm, 10 cm, 12 cm or any value therebetween. For example, the ringout distance may be greater than 5 mm. In another example, the ringout distance may be less than 12 cm. In yet other examples, the ringout distance may be any value in a range between 5 mm and 12 cm. In some embodiments, it may be critical that the ringout distance is between 1 mm and 3 cm to allow the drilling operator to identify when ringout has occurred. In this way, the brake element 218 may engage the borehole wall and indicate that the expandable tool 211 is no longer widening the borehole to a gauge diameter and that ringout of the expandable tool 211 has begun.

In some embodiments, multiple brake elements 218 may be embedded in the expandable block 216. At least a portion of the brake elements 218 may be positioned and configured according to the various embodiments discussed above. In this way, different brake elements 218 may be configured to engage the borehole wall corresponding to different levels of wear of the expandable block 216. For example, a first portion of the brake elements 218 may be positioned to indicate a first degree of ringout, and a second portion of the plurality of brake elements 218 may be positioned to indicate a second degree of wear more severe than that of the first degree of ringout. In this way, multiple brake elements 218 may indicate the degree of ringout of the expandable tool 211.

The brake element 218 may be embedded in the expandable block 216 at an angular orientation. For example, the brake element 218 may be angled with respect to a longitudinal plane of the expandable block 216. As will be discussed herein in detail in connection with FIGS. 3-1 and 3-2, the angle of the brake element 218 with respect to the longitudinal plane may correspond to a profile angle β of the brake element 218. The profile angle β may be defined between a line normal to the borehole wall and a longitudinal axis of the brake element 218.

Figures 2, 3, 4:
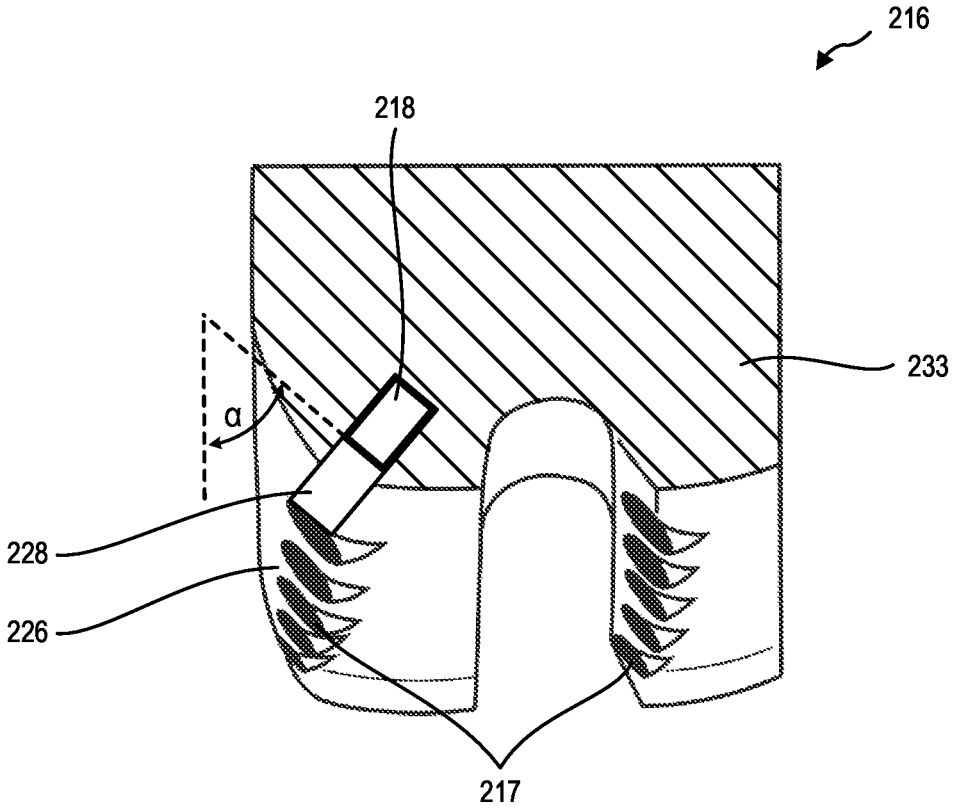

FIG. 2-4 is a top-down cross-sectional view and FIG. 2-5 is a front cross-sectional view of the expandable block 216 of FIG. 2-1. As just mentioned, the brake element 218 may be embedded in the expandable block 216 at an angular orientation. The brake element 218 may be angled with respect to a radial plane of the expandable block 216. As will be discussed herein in detail in connection with FIGS. 3-1 and 3-2, the α of the brake element 218 with respect to the radial plane may correspond to a rake angle α of the brake element 218. The rake angle α may be defined between a line normal to the borehole wall and an engagement face 223 of the brake element 218.

The brake element 218 may be inserted into the cavity 228 and connected to the expandable block 216. Put another way, the brake element 218 may be an insert that is connected to the expandable block 216. In some embodiments, the brake element 218 may be the same (e.g., have the same structure and/or composition) as one or more of the cutting elements 217. In some embodiments, the brake element 218 may be different than one or more of the cutting elements 217.

In some embodiments, the brake element 218 may be configured to engage the borehole wall with an engagement face 223. In some embodiments, the brake element 218 may be a planar element with an engagement face 223 that is substantially planar. In some embodiments, the brake element 218 may be a non-planar element, such as a conical element, with an engagement face 223 that is non-planar. The brake element 218 may be any other shape suitable for engaging the borehole wall to indicate ringout of the expandable tool 211 as disclosed herein.

The brake element 218 may be made of any material. For example, the brake element 218 may be made of an ultrahard material. As used herein, the term "ultrahard" is understood to refer to those materials known in the art to have a grain hardness of about 1,500 HV (Vickers hardness in kg/mm2) or greater. Such ultrahard materials can include but are not limited to diamond, sapphire, moissanite, hexagonal diamond (Lonsdaleite), cubic boron nitride (cBN), polycrystalline cBN (PcBN), Q-carbon, binderless PcBN, diamond-like carbon, boron suboxide, aluminum manganese boride, metal borides, boron carbon nitride, PCD (including, e.g., leached metal catalyst PCD, non-metal catalyst PCD, and binderless PCD or nanopolycrystalline diamond (NPD)) and other materials in the boron-nitrogen-carbon-oxygen system which have shown hardness values above 1,500 HV, as well as combinations of the above materials. In some embodiments, the ultrahard material may have a hardness value above 3,000 HV. In other embodiments, the ultrahard material may have a hardness value above 4,000 HV. In yet other embodiments, the ultrahard material may have a hardness value greater than 80 HRa (Rockwell hardness A). In some examples, the brake element 218 may be formed from any other material including metals, metallic alloys, ceramic materials, any other material, and combinations thereof.

As described herein, when the brake element 218 engages the borehole wall, it may change the behavior of the drilling system. For example, the expandable tool 211 may experience a change in TOR and/or WOR. As another example, a downhole system may experience a change in a ROP. An orientation of the brake element 218 in relation to the expandable block 216 may result in one or more of the changes in behavior of the drilling system.

As can be seen in FIGS. 2-2 to 2-5 (and specifically in FIG. 2-3), the brake element 218 may have a profile angle β that is different than the profile angle β of the cutting elements 217. Different profile angles β may cause the brake element 218 to change the WOR when the brake element 218 engages the borehole wall in comparison to when the cutting elements engage the borehole wall. As discussed herein, the WOR increase caused by the brake element 218 may be detectable at the surface as a detected increase in the WOB, thereby alerting the drilling operator that the expandable tool 211 has experienced ringout.

In some embodiments, the WOR increase may be in a range having an upper value, a lower value, or upper and lower values including any of an increase to 20%, 30%, 40%, 50%, 60%, 70%, 80%, 90%, 100%, or any value therebetween of the bottom hole assembly weight. For example, the WOR increase may be an increase to greater than 20% of the bottom hole assembly weight. In another example, the WOR increase may be an increase to less than 100% of the bottom hole assembly weight. In yet other examples, the WOR increase may be an increase to any value in the range between 20% and 100% of the bottom hole assembly weight. In some embodiments, it may be critical that the WOR increase be an increase to between 40% and 80% of the bottom hole assembly weight to allow the drilling operator to identify when ringout has occurred.

When the brake element 218 engages the borehole wall, the ROP may decrease with a ROP decrease, thereby alerting the drilling operator that the expandable tool 211 has experienced ringout. For example, the ROP decrease may be a decrease of 50%. In some embodiments, the ROP decrease may be in a range having an upper value, a lower value, or upper and lower values including any of 20%, 30%, 40%, 50%, 60%, 70%, 80%, 90%, 100%, or any value therebetween. For example, the ROP decrease may be greater than 20%. In another example, the ROP decrease may be less than 100%. In yet other examples, the ROP decrease may be any value in a range between 20% and 100%. In some embodiments, it may be critical that the ROP decrease is between 25% and 98% to allow the drilling operator to identify when ringout has occurred.

As can be seen in FIGS. 2-2 to 2-5 (and specifically in FIG. 2-4), the brake element 218 may have a rake angle α that is larger than the rake angle α of the cutting elements 217. This may result in a TOR decrease, thereby reducing the TOB measured at the surface. In some embodiments, the TOR decrease may be in a range having an upper value, a lower value, or upper and lower values including any of 20%, 30%, 40%, 50%, 60%, 70%, 80%, 90%, 100%, or any value therebetween. For example, the TOR decrease may be greater than 20%. In another example, the TOR decrease may be less than 100%. In yet other examples, the TOR decrease may be any value in a range between 20% and 100%. In some embodiments, it may be critical that the TOR decrease is between 25% and 85% to allow the drilling operator to identify when ringout has occurred.

As discussed herein, the drilling system may determine a depth of various downhole tools, such as the expandable tool 211. In accordance with at least one embodiment of the present disclosure, the depth of the expandable tool 211 may be associated with a ringout event. For example, as discussed herein, one or more of the SWOB sensor, the STOB sensor, or the ROP sensor may detect when the brake element 218 engages the wellbore wall. The operator may determine and associate the depth of the expandable tool 211 at this point. In this way, the drilling system may use the determined depth associated with the SWOB sensor, STOB sensor, and/or ROP sensor to indicate a specific portion of the borehole where the downhole tool experienced ringout.

FIG. 3-1 is a schematic view of an expandable block 316, according to at least one embodiment of the present disclosure. The expandable block 316 may be part of an expandable tool coupled to a BHA, drill rig, or other element of a downhole drilling assembly. As illustrated in FIG. 3-1, the view shown may correspond to a view of the x-y plane with the z axis being perpendicular to the page. The x-y plane may be a radial plane or may correspond to the plane of rotation of a radius of the expandable tool. For example, the expandable block 316 may rotate about an axis of rotation 312. The axis of rotation 312 may extend into the z direction. In some embodiments, the axis of rotation 312 may be the axis of rotation 212 as discussed herein in connection with FIG. 2-3. The expandable block 316 may include an engagement element 313 configured to engage an earth formation 301. The engagement element 313 may be any element discussed herein that engages the wellbore wall, such as a cutting element, a brake element, a gauge element, a wear element, any other engagement element, and combinations thereof. The engagement element 313 may be positioned on the expandable block 316 to engage a borehole wall 330 with an engagement face 323. In some embodiments, the engagement element 313 may include an ultrahard insert 323-1. For example, the ultrahard insert 323-1 may be positioned on a distal end of the engagement element 313 and may at least partially define the engagement face 323. In some embodiments, the ultrahard insert 321-1 may be made of an ultrahard material, as discussed herein, to resist wearing of the engagement element 313. The ultrahard insert 323-1 may be a diamond table of the engagement element 313. While the borehole wall 330 shown in FIG. 3-1 is vertical, it should be understood that the borehole wall 330 may be oriented in any direction with respect to a wellbore axis. For example, the borehole wall 330 may be parallel to the wellbore axis, perpendicular to the wellbore axis, curved between parallel and perpendicular to the wellbore axis, oriented at any other angle with respect to the wellbore axis, and combinations thereof. In some embodiments, the rake angle may change as the orientation of the borehole wall 330 changes.

The orientation of the engagement element 313 with respect to the expandable block 316 may define a rake angle $\alpha$, measured on the radial plane between the engagement face 323 and a normal line 325. The normal line 325 may be any line that is normal or orthogonal to the borehole wall 330. In this way, the rake angle $\alpha$ is a measure of the angular orientation of the engagement element 313 with respect to the x-y plane, or radial plane. In other words, the rake angle $\alpha$ lies on the x-y plane, or radial plane. For example, a rake angle $\alpha$ of 0° between the engagement face 323 and the normal line 325 may correspond to the x-y component of the engagement face 323 being substantially perpendicular or orthogonal to the borehole wall 330. Put another way, a rake angle $\alpha$ of 0° between the engagement face 323 and any line orthogonal to the borehole wall 330 may correspond to the component of the engagement face 323 on the radial plane being substantially perpendicular or orthogonal to the borehole wall. In another example, a rake angle $\alpha$ of 90° between the engagement face 323 and the normal line 325 may correspond to the x-y component (i.e., component on the radial plane) of the engagement face 323 being substantially tangent or parallel to the borehole wall 330. A smaller rake angle $\alpha$ may correspond to the x-y component of the engagement face 323 being more aggressive or have a higher resistance to rotation of the expandable block 316. A larger rake angle $\alpha$ may correspond to the x-y component of the engagement face 323 being less aggressive or have a lower resistance to rotation of the expandable block 316.

As is discussed herein in detail in connection with FIG. 3-2, the orientation of the engagement element may also be defined by a profile angle $\beta$. As an aid in discussing the rake angle $\alpha$, the engagement element 313 is shown in FIG. 3-1 as having a profile angle $\beta$ of 0°. It should be understood, however, that the engagement element 313 may have any profile angle $\beta$ (in accordance with that discussed herein) in addition to or in combination with any rake angle $\alpha$ (in accordance with that discussed herein). In this way, the orientation of the engagement element may be defined by both the rake angle $\alpha$ and the profile angle $\beta$ to represent any orientation of the engagement element in 3-dimensional space.

As discussed herein, the expandable block 316 may include one or more cutting elements and/or one or more brake elements. A cutting element may have a cutting rake angle and a brake element may have a brake rake angle. For example, the engagement face 323 of a cutting element may be a cutting face, and a cutting rake angle may be measured relative to the cutting face. In some embodiments, the brake rake angle may be greater than the cutting rake angle. In some embodiments, the brake rake angle may be less than the cutting rake angle. In some embodiments, the different rake angle $\alpha$ of the cutting elements and of the brake element may correspond to a change in the TOR when the brake element engages the borehole wall 330. For example, the different rake angle $\alpha$ of the cutting elements and of the brake element may correspond to a decrease in the torque on the expandable tool when the brake element engages the borehole wall 330. In some examples, the different rake angle $\alpha$ of the cutting elements and of the brake element may correspond to an increase in the torque on the expandable tool when the brake element engages the borehole wall 330.

In some embodiments, the cutting face of the cutting elements may be oriented with respect to the borehole wall at a more aggressive angle than the engagement face of the brake element. In other words, the cutting rake angle may be smaller than the brake rake angle. In some embodiments, the brake rake angle may be approximately 70°. In some embodiments, the brake rake angle may be in a range having an upper value, a lower value, or upper and lower values including any of 45°, 50°, 60°, 70°, 80°, 90°, or any value therebetween. For example, the brake rake angle may be greater than 45°. In another example, the brake rake angle may be less than 90°. In yet other examples, the brake rake angle may be any value in the range between 45° and 90°. In some embodiments, it may be critical that the brake rake angle be between 70° and 90° to allow the drilling operator to identify when ringout has occurred.

In some embodiments, the cutting rake angle may be in a range having an upper value, a lower value, or upper and lower values including any of −30°, −25°, −20°, −15°, −10°, −5°, 0°, 5°, 10°, 15°, 20°, 25°, 30°, or any value therebetween. For example, the cutting rake angle may be greater than −30°. In another example, the cutting rake angle may be less than 30°. In yet other examples, the cutting rake angle may be any value in the range between −30° and 30°.

While the cutting face shown is planar, it should be understood that the cutting face of the cutting element and/or the brake element may have any shape, such as non-planar, beveled, variable, and so forth. The rake angle may be defined based on the contact between the cutting face and the borehole wall. For example, the contact of the cutting face and the wellbore wall may be at a curved surface, and the rake angle may be the angle of a line or plane tangent to the contact of the curved surface with the wellbore wall. In some embodiments, a cutting element and/or a brake element may include multiple rake angles. The rake angles discussed herein may include a single rake angle and/or an average rake angle of the multiple rake angles.

The brake element may resist rotational motion of the expandable tool to a lesser degree than the cutting elements when the brake rake angle is larger than the cutting rake angle by a rake angle difference. This may correspond to a lower torque experienced by the expandable tool. As discussed herein, the reduced torque may indicate to an operator at the surface of the borehole that the expandable tool has experienced ringout. In some embodiments, the rake angle difference may be greater or less than 45°. In some embodiments, the rake angle difference may be in a range having an upper value, a lower value, or upper and lower values including any of −90°, −80°, −70°, −60°, −50°, −40°, −30°, −20°, −10°, 10°, 20°, 30°, 40°, 50°, 60°, 70°, 80°, 90°, or any value therebetween. For example, the rake angle difference may be greater than 10°. In another example, the rake angle difference may be less than 90°. In yet other examples, the rake angle difference may be any value in the range between 10° and 90°. In some embodiments, it may be critical that the rake angle difference be between 45° and 90° to allow the drilling operator to identify when ringout has occurred.

FIG. 3-2 is a side cross-sectional diagram of an expandable block 316 according to at least one embodiment of the present disclosure. As illustrated in FIG. 3-2, the side view may correspond to a view of the x-z plane with the y axis being perpendicular to the page. The x-z plane may be a longitudinal plane or may correspond to the plane that contains the longitudinal of the expandable tool. The longitudinal axis of the expandable tool may be the axis of rotation 312 about which the expandable tool and/or the expandable block 316 rotates. In some embodiments, the axis of rotation 312 may be the axis of rotations 212 as discussed herein in connection with FIG. 2-3. The orientation of the engagement element 313 with respect to the expandable block 316 may define a profile angle β, measured on the longitudinal plane between a longitudinal axis 327 of the body of the engagement element 313 and the normal line 325 (e.g., any line that is normal or orthogonal to the borehole wall 330 as in FIG. 3-2). As described herein, the normal line 325 may be any line that is orthogonal to the borehole wall 330. In this way, the profile angle β is a measure of the angular orientation of the engagement element 313 with respect to the x-z plane, or longitudinal pane. In other words, the profile angle lies on the x-z plane, or longitudinal plane. For example, a profile angle β of 0° between the engagement face 323 and the normal line 325 may correspond to the x-z component of the engagement face 323 being substantially parallel to the borehole wall 330. Put another way, a profile angle β of 0° between the engagement face 323 and any line orthogonal to the borehole wall 330 may correspond to the component of the engagement face 323 on the longitudinal plane being substantially parallel to the borehole wall 330. A profile angle β of 0° may correspond to a wear element such as a stabilization pad that is intended to engage the borehole wall 330 but not cut or remove material from the borehole wall 330. A profile angle β of 0° may correspond to one or more configurations of the brake element as discussed herein. In another example, a profile angle β of 90° between the engagement face and the normal line 325 may correspond to the x-z component (i.e., component on the longitudinal plane) of the engagement face 323 being substantially perpendicular to the borehole wall 330. The profile angle β may correspond to the downward facing or longitudinal component of the orientation of the engagement face 223 in relation to the expandable block 216 as describe herein in conjunction with FIGS. 2-2 to 2-4.

A larger profile angle β may correspond to the x-z component of the engagement face 323 being more aggressive with a higher resistance to the downhole penetration of the expandable block 316 in relation to the borehole wall. A smaller profile angle β may correspond to the engagement face 323 being less aggressive with a lower resistance to downhole motion of the expandable block 316.

As is discussed herein in detail in connection with FIG. 3-1, the orientation of the engagement element may also be defined by a rake angle α. As an aid in discussing the profile angle β, the engagement element 313 is shown in FIG. 3-2 as having a rake angle α of 90°. It should be understood, however, that the engagement element 313 may have any rake angle α (in accordance with that discussed herein) in addition to or in combination with any profile angle β (in accordance with that discussed herein). In this way, the orientation of the engagement element may be defined by both the rake angle α and the profile angle β independent of one another to represent any orientation of the engagement element in 3-dimensional space.

As discussed herein, in some embodiments the expandable block 316 may include a plurality of engagement elements 313, including cutting elements and/or brake elements. The cutting elements may have a cutting profile angle and the brake elements may have a brake profile angle. For example, the engagement face 323 of a cutting element may be a cutting face, and the cutting profile angle may be measured relative to the cutting face. In some embodiments, the brake profile angle may be greater than the cutting profile angle. In some embodiments, the brake profile angle may be less than the cutting profile angle. In some embodiments, the different profile angle β of the cutting elements and of the brake element may correspond to a change in the WOR and/or ROP of the expandable tool when the brake element engages the borehole wall 330. For example, the different profile angle β of the brake element and of the cutting elements may correspond to an increase in the WOR and/or a decrease in the ROP of the expandable tool when the brake element engages the borehole wall 330. In some embodiments, the different profile angle β of the brake element and of the cutting elements may correspond to decrease in the WOR and/or an increase in the ROP of the expandable tool when the brake element engages the borehole wall 330.

In some embodiments, the cutting face of the cutting elements may be oriented with respect to the borehole wall at a less aggressive angle than the engagement face of the brake element. In other words, the cutting profile angle may be smaller than the brake profile angle. In some embodiments, the brake profile angle may be in a range having an upper value, a lower value, or upper and lower values including any of 0°, 10°, 20°, 30°, 40°, 45°, 50°, 60°, 70°, 80°, 90°, or any value therebetween. For example, the brake profile angle may be greater than 0°. In another example, the brake profile angle may be less than 90°. In yet other examples, the brake profile angle may be any value in the range between 0° and 90°. In some embodiments, it may be critical that the brake profile angle be between 60° and 90° to allow the drilling operator to identify when ringout has occurred.

In some embodiments, the cutting profile angle may be in a range having an upper value, a lower value, or upper and lower values including any of 180°, −150°, −120°, −90°, −75°, −60°, −45°, −30°, −15°, 0°, 10°, 20°, 30°, 40°, 45°, 50°, 60°, 70°, 80°, 90°, 120°, 150°, 180°, or any value therebetween. For example, the cutting profile angle may be greater than 0°. In another example, the cutting profile angle may be less than 45°. In yet other examples, the cutting profile angle may be any value in the range between 0° and 45°.

A larger brake profile angle may correspond to a larger axial force, or WOR experienced by the expandable tool when the brake element engages the borehole wall 330 than when the cutting elements of the cutter profile engage the borehole wall 330. For example, as discussed herein, when the brake element engages the borehole wall 330, the expandable tool may experience a greater WOR and/or reduced ROP because the brake profile angle is larger than the cutting profile angle. As discussed herein, the increased WOR and/or reduced ROP may indicate to an operator at the surface of the borehole that the expandable tool has experienced ringout.

In some embodiments, the changes in WOR and/or ROP may be large enough to be distinguishable from the noise and/or variation in measurements of the WOB and/or ROP sensors at the surface. For example, the brake profile angle may be a different profile angle β than the cutting profile angle by a profile angle difference. In some embodiments, the profile angle difference may be in a range having an upper value, a lower value, or upper and lower values including any of 15°, 20°, 30°, 40°, 50°, 60°, 70°, 80°, 90°, or any value therebetween. For example, the profile angle difference may be greater than 15°. In another example, the profile angle difference may be less than 90°. In yet other examples, the profile angle difference may be any value in the range between 15° and 90°. In some embodiments, it may be critical that the profile angle difference be between 45° and 90° to increase the WOR and/or decrease the ROP enough to allow the drilling operator at the surface to identify when ringout has occurred.

FIG. 4-1 is an exploded perspective view of an expandable block 416, according to at least one embodiment of the present disclosure. The expandable block 416 may be part of an expandable tool coupled to a BHA, drill rig, or other element of a downhole drilling assembly. The expandable block 416 may include one or more cutting elements 417 embedded in and located at a periphery of the expandable block 416. The expandable block may include a brake element 418. The brake element 418 may insert into a cavity 428 and connect to the body of the expandable block 416.

In some embodiments, the cavity 428 may be formed with an exterior hole on an outer surface 426 of the expandable block 416. For example, the brake element 418 may be connected to the expandable block 416 by inserting the brake element 418 into the cavity 428 from a radially outer location 431. In some embodiments, the cavity 428 may be formed with an exterior hole on an inner surface 440 of the expandable block 416. For example, the brake element 418 may be connected to the expandable block 416 by inserting the brake element 418 into the cavity 428 from a radially inner location 432. In some embodiments, the cavity 428 may be a through-hole that extends through an entirety of the expandable block 416. For example, the brake element 418 may be connected to the expandable block 416 by inserting the brake element 418 into the cavity from either the radially inner location 432 or the radially outer location 431. In some embodiments, the cavity 428 may be formed during manufacturing of the expandable block 416. In some embodiments, the cavity 428 may be formed as part of a retrofit of an existing expandable block.

In some embodiments, the brake element 418 may be configured to engage the borehole wall throughout various degrees of wear of the expandable block 416 corresponding to various degrees of reduction in diameter of the expandable tool at the brake element 418. For example, as may be seen in FIG. 4-1 and FIG. 4-2, the brake element 418 has an elongated shape. In this way, the brake element 418 may wear down to a shorter length and continue to engage the borehole wall. This may increase the amount of time the brake element 418 changes the WOB, TOB, and/or ROP measured at the surface, thereby helping to ensure that the drilling operator notices the changes in drilling properties.

In some embodiments, the brake element 418 may have an elongated shape and may be positioned within the expandable block 416 such that the brake element 418 penetrates through a majority of the thickness of the body of the expandable block 416. The ultrahard and/or friction properties of the engagement face 423 may be present through an entirety of the length of the brake element 418.

In some embodiments, as shown in FIG. 4-3 and FIG. 4-4, the brake element 418 may be composed of two or more of units 419. In some embodiments, the units 419 may be individual brake elements of brake element 418. In some embodiments, some of the units 419 may be brake elements 418 and some of the units may be other engagement elements, such as a cutting element 417 and/or a gauge element. The units 419 may be inserted and/or stacked inside of the cavity 428 as shown in FIG. 4-3. In some embodiments, the units 419 may be integrally formed as one piece as shown in FIG. 4-4. In some embodiments, the outermost portion of the units 419 may be the first portion of the units 419 to engage the borehole wall and may wear as the expandable block 416 wears. In this way, the next portion of the units 419 of the brake element 418 may over time become exposed and engage the borehole wall.

In some embodiments, the units 419 may be made of the same material and/or have the same orientation. For example, each of the units 419 may exhibit the same material properties and the brake element 418 may adjust the WOB, TOB, and/or ROP experienced at the surface in the same way. In some embodiments, at least some of the units 419 may be made of different materials and/or have different orientations. For example, at least some of the units 419 may have different wear-resistant properties and may wear faster or slower than other portions of the units 419. In some examples, at least some of the units 419 may have a different coefficient of friction and may engage the borehole wall with more or less friction than other portions of the units 419. In some examples, the units 419 may have different orientations and engage the formation with a different rake and/or profile angle. In this way, some of the units 419 may change the WOB, TOB, and/or ROP measured at the surface in different ways. In this manner, different portions of the units 419 of the brake element 418 may indicate a specific level of wear of the expandable block 416 corresponding to a specific reduction in diameter of the expandable tool.

In some embodiments, some of the units 419 may be different engagement elements of the expandable block 416. For example, some of the units may be cutting elements 417 and some of the units 419 may be brake elements 418. In another example, some of the units may be gauge elements and some of the units may be brake elements 418. The units 419 may be any other elements of the expandable block 416 for engaging the borehole wall, or combinations thereof. In this way, one or more brake elements 418 may be positioned rotationally behind, underneath, or radially inward of one or more engagement elements of the expandable block 416, and the brake elements 418 may become exposed once the outer engagement elements have worn.

Figures 2, 3, 4, 5:
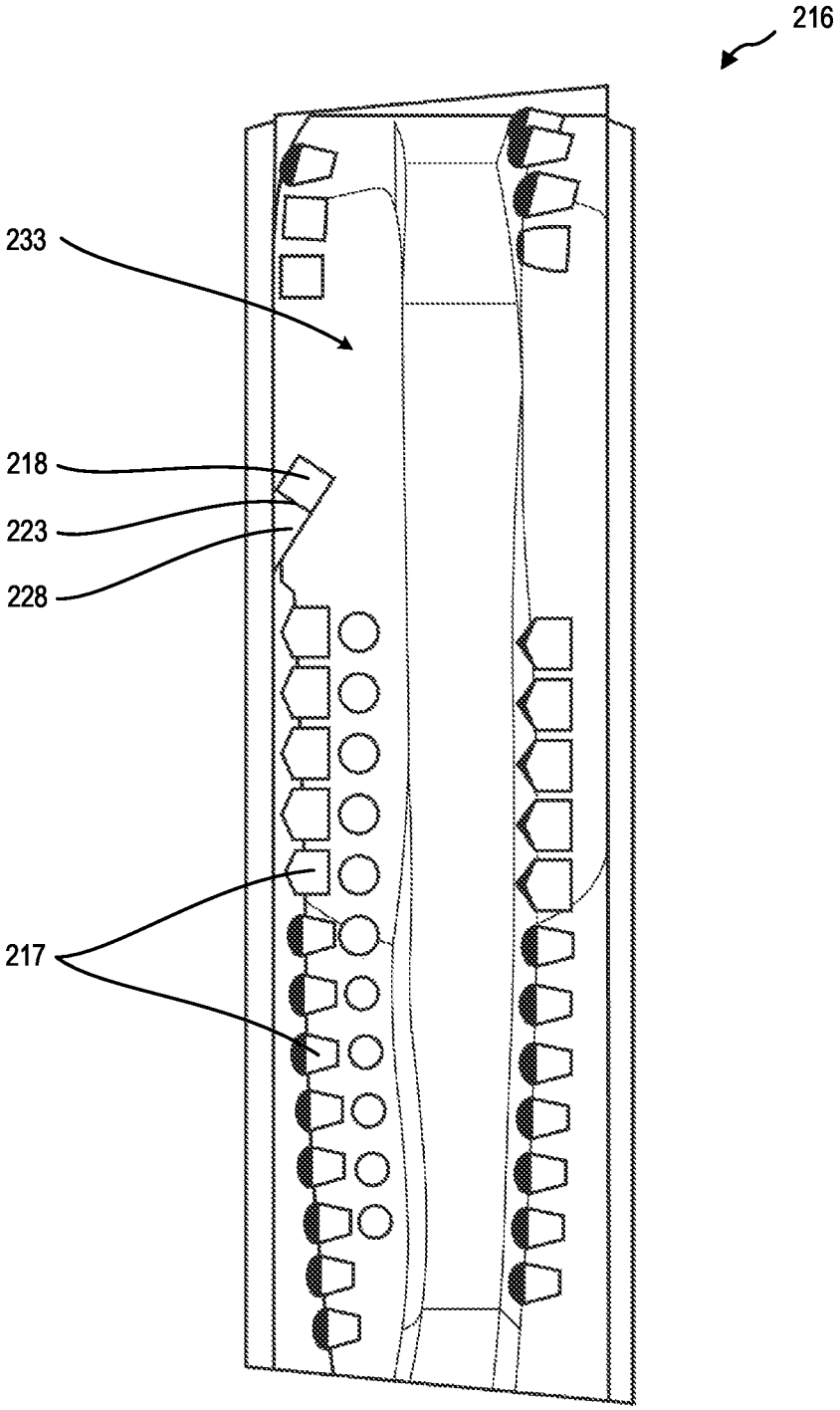
Figures 1, 3:
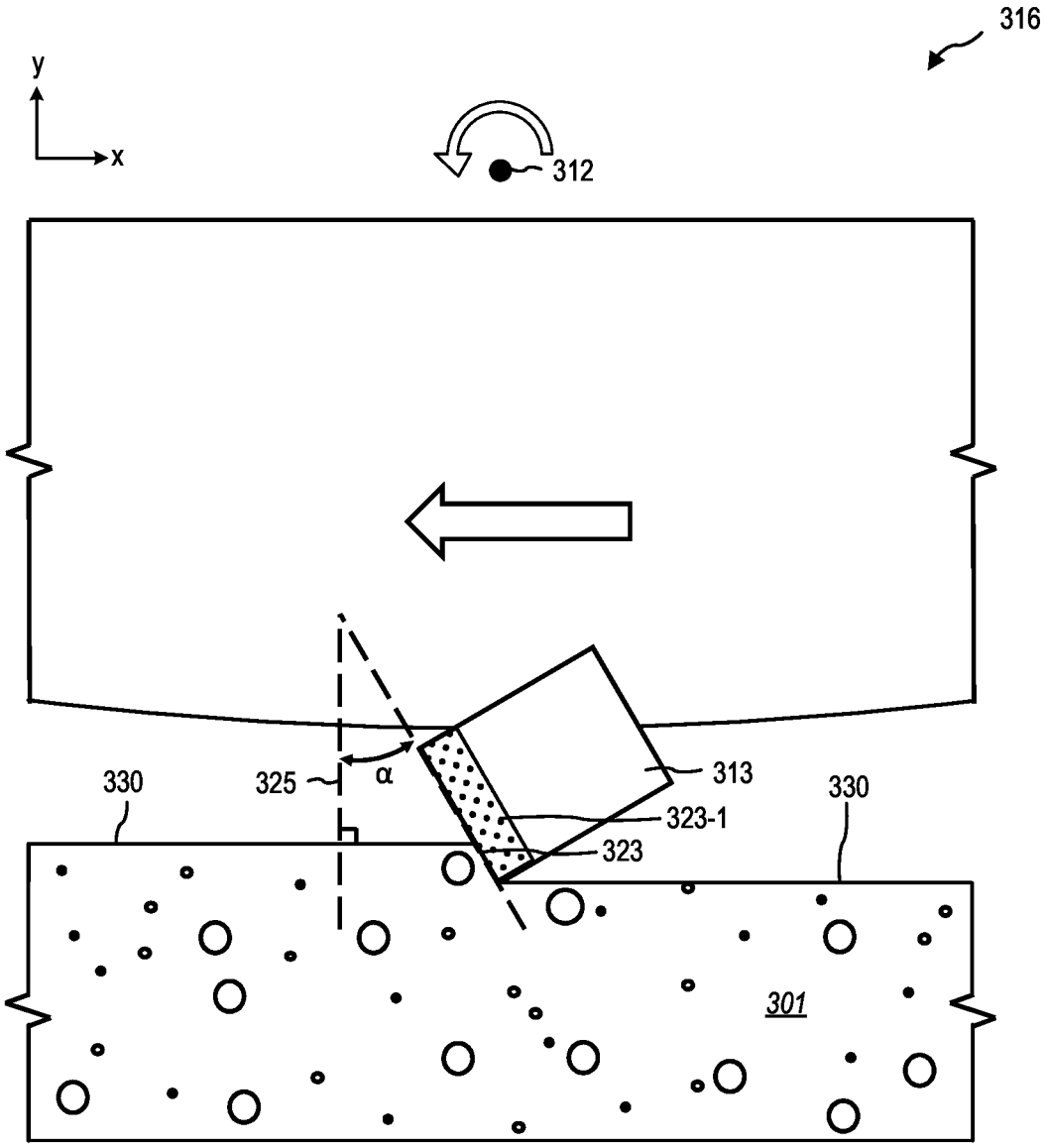
Figures 2, 3:
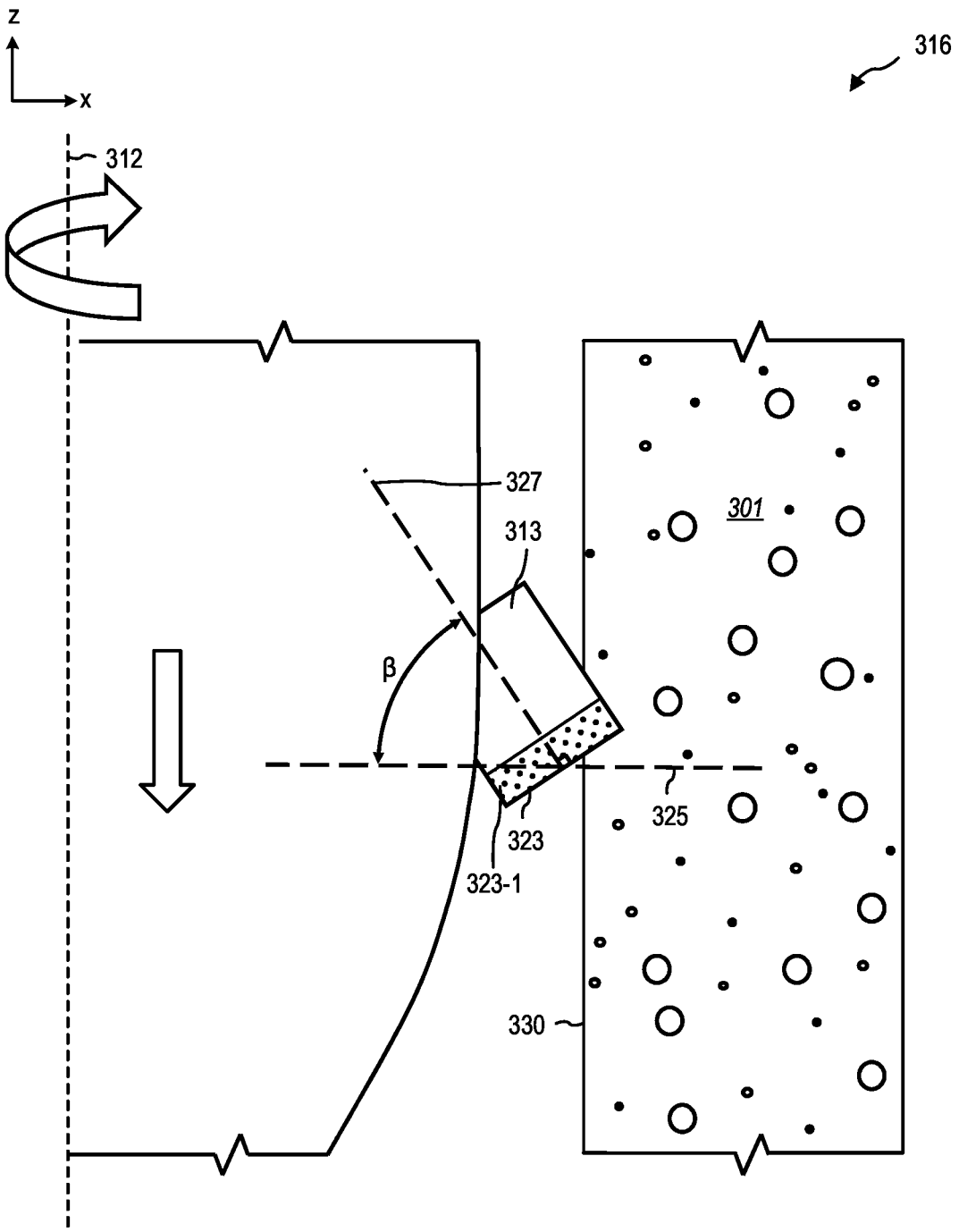

FIG. 4-5 is a cross-sectional view normal to a block profile, according to at least one embodiment of the present disclosure, at least one of the units may be a cutting element 417 and at least one of the units may be a brake element 418. The cutting element 417 may be any type of cutting element, such as a gauge element, a wear element, any other type of cutting element, and combinations thereof. The cutting element 417 may be positioned on the expandable block 416 to engage the borehole wall. In some embodiments, the cutting element 417 may cut or refine the borehole wall. As shown in FIG. 4-5, the brake element 418 may be positioned behind or underneath the cutting element 417. Put another way, the brake element 418 may be positioned radially inward of the cutting element 417. In this way, as the cutting element 417 wears, the brake element 418 may become exposed and engage the borehole wall. In some embodiments, the brake element 418 may have a different orientation than the cutting element 417 and may engage the borehole wall with a different rake and/or profile angle. In some embodiments, the brake element 418 may have an engagement face that is different from an engagement face of the cutting element 417. For example, the brake element 418 and the cutting element 417 may each have an engagement face with different wear resistant properties, shape or geometry, coefficients of friction, other material properties, or combinations thereof. In some embodiments, the brake element may engage the borehole wall in a different way than the cutting element 417 and may change the SWOB, STOB, and/or ROP. In this way, the brake element may alert an operator that the cutting element 417 has worn.

Figures 1, 4:
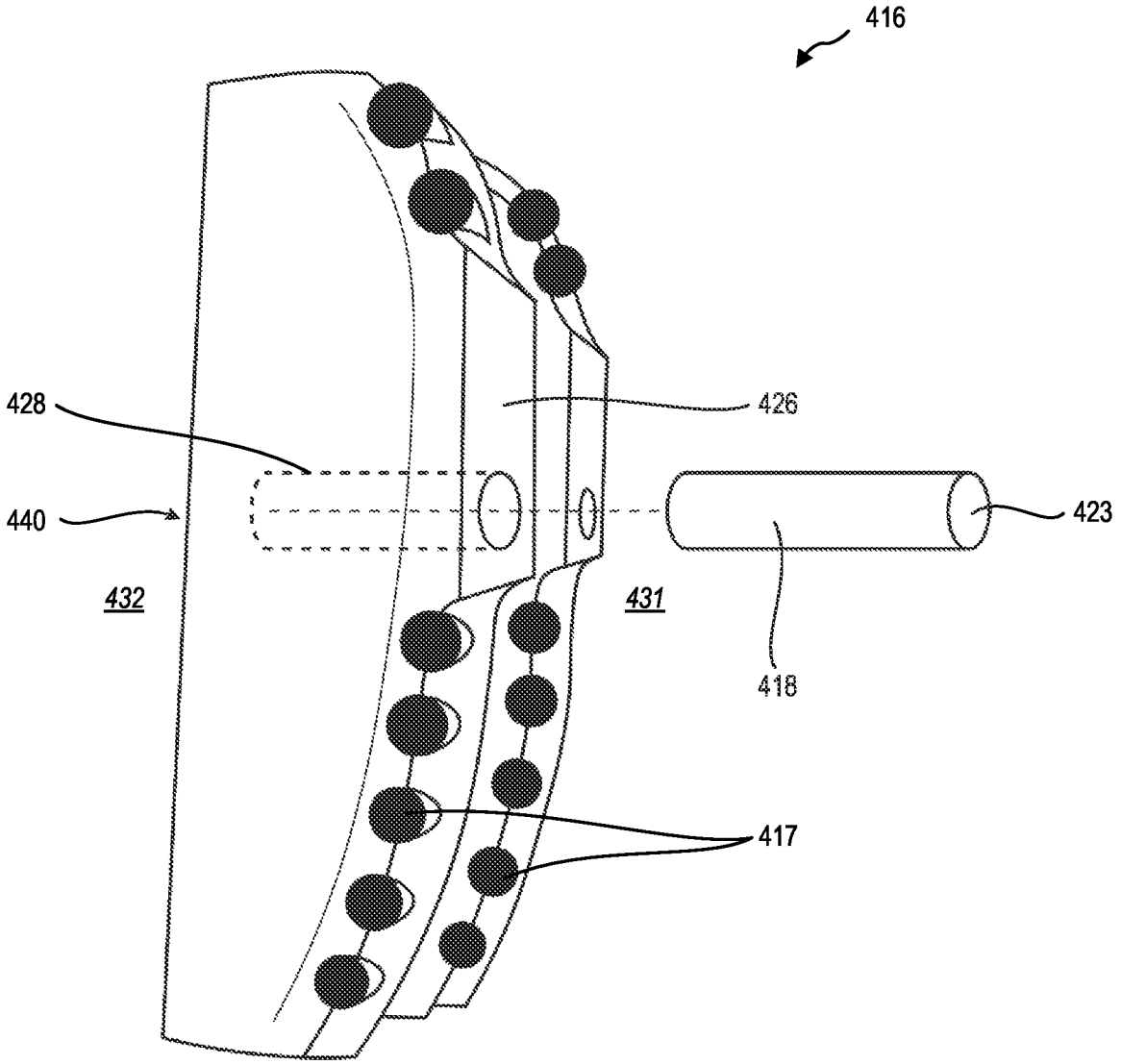
Figures 2, 4:
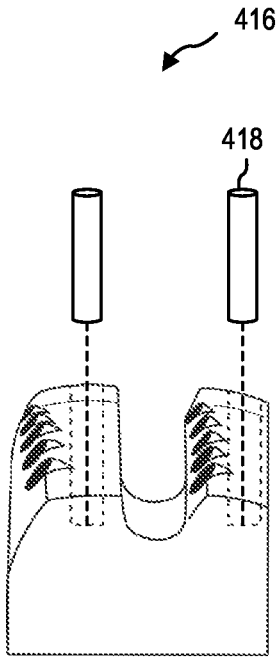
Figures 3, 4:
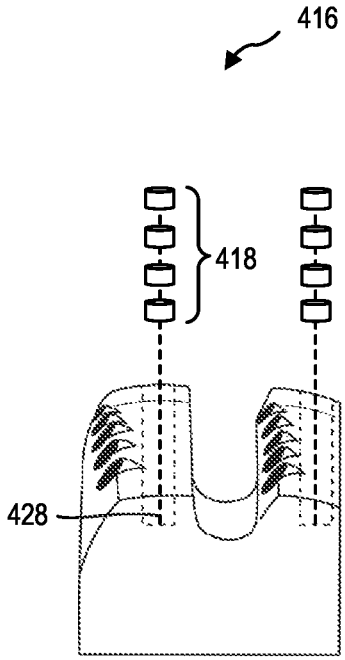
Figure 4:
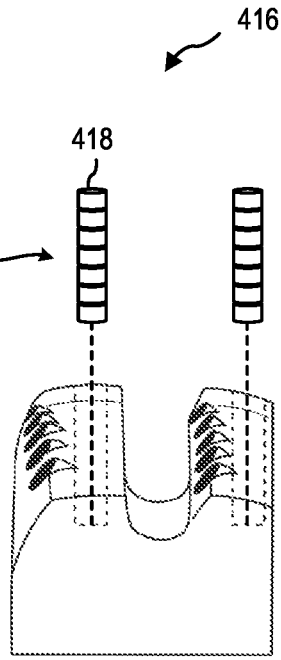
Figures 4, 5:
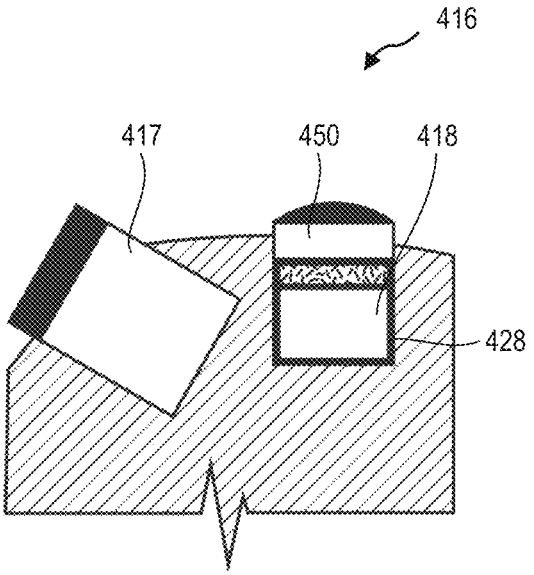
Figures 4, 5, 6:
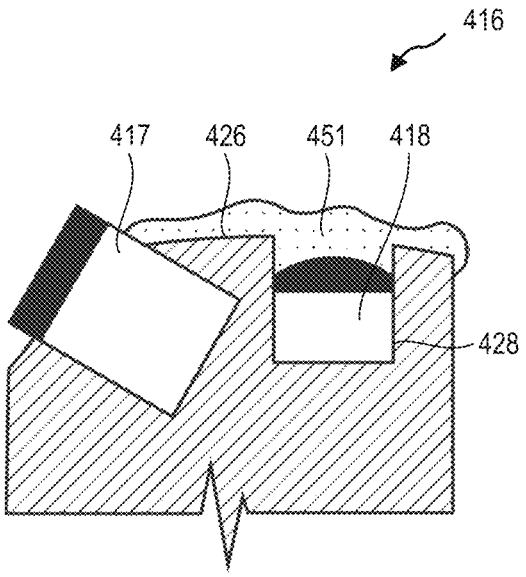
Figures 4, 5, 6, 7:
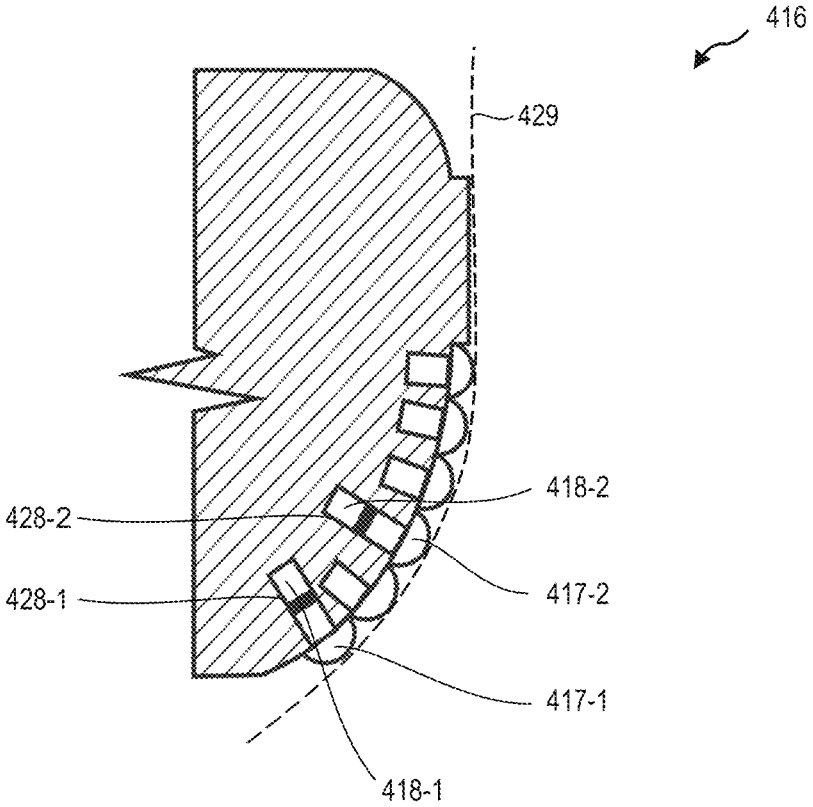
Figure 5:
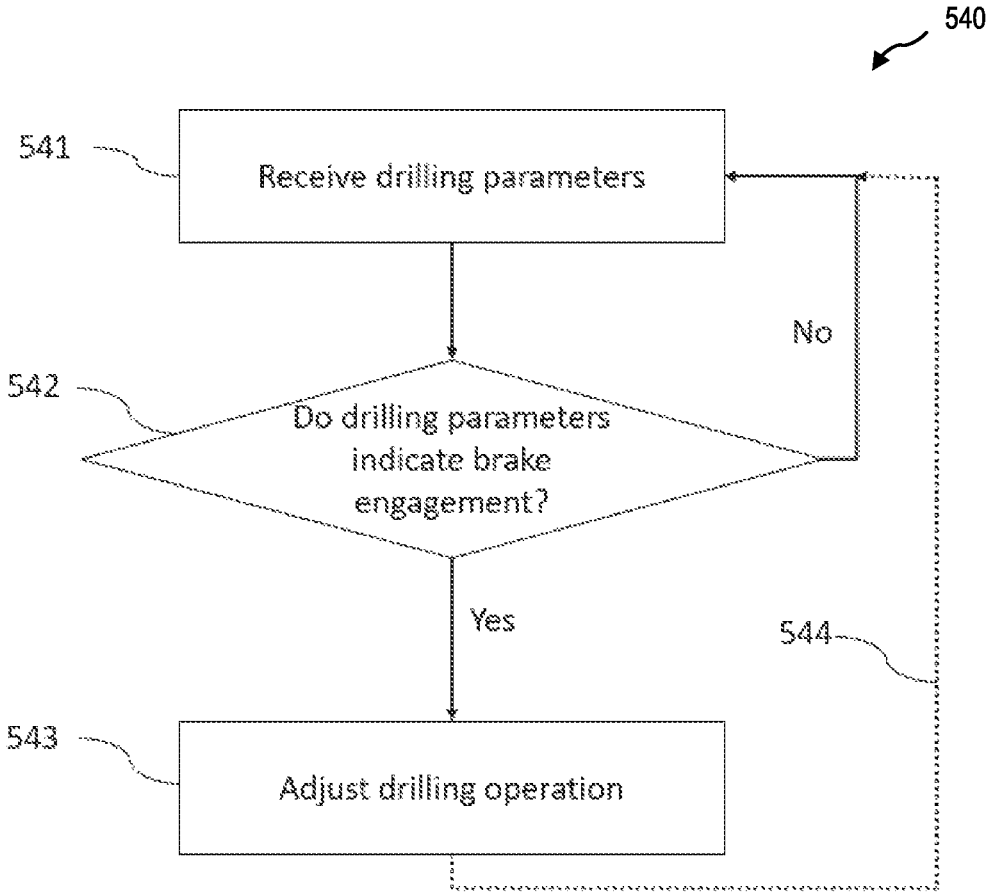

As discussed herein, the expandable block 416 may include a cavity 428, and the brake element 418 may be disposed in (e.g., embedded within) the cavity 428 and thereby connected to the expandable block 416. As shown in FIG. 4-6, in some embodiments the brake element 418 may not extend past an outer surface 426 of the expandable block 416. In some embodiments, the expandable block 416 may include a hardfacing 451. In some embodiments, at least a portion of the outer surface 426 may include the hardfacing 451. The hardfacing 451 may be a wear-resistant material, such as a coating of an ultrahard material deposited on one or more surfaces of the expandable block 416. For example, the outer surface 426 and/or any other portion of the expandable block 416 may be covered in the hardfacing 451. This may provide wear-resistance for the outer surface 426 and/or any other exposed face of the expandable block 416. In some embodiments, the hardfacing 451 may at least partially cover an opening of the cavity 428. For example, the hardfacing may fill the empty portion of the cavity 428 above, in front of, or radially outward from the brake element 418. This may protect the brake element 418 and/or the cavity 428 from damage or wear until such time that the brake element may become exposed. Over time the hardfacing 451 may wear. This may expose the cavity 428 and/or the brake element 418. As discussed herein, the brake element 418 may engage the borehole wall which may indicate that the hardfacing 451 and/or the expandable block 416 has worn.

In some embodiments, the expandable block 416 may include multiple instances of the brake element 418 positioned behind one or more engagement elements. For example, the expandable block 416 may include at least one brake element 418 positioned behind a cutting element 417 and at least one other brake element 418 positioned behind another cutting element 417. In another example, the expandable block 416 may include at least one brake element 418 positioned behind multiple distinct cutting elements 417.

As shown in FIG. 4-7, according to at least one embodiment of the present disclosure, the expandable block 416 may include a first cutting element 417-1 and a second cutting element 417-2. The first cutting element 417-1 may be disposed in a first cavity 428-1. The second cutting element 417-2 may be disposed in a second cavity 428-2. The second cutting element 417-2 may be positioned at a different longitudinal location along a cutting profile 429 than the first cutting element 417-1. In this way, the first cutting element 417-1 may correspond to a first longitudinal location along the cutting profile 429 and the second cutting element 417-2 may correspond to a second longitudinal location along the cutting profile 429. In some embodiments, the cutting profile 429 may be curved or oriented radially inward. In this way, the first cutting element 417-1 and/or the first longitudinal location may correspond to a first radial location along the expandable block 416, and the second cutting element 417-2 and/or the second longitudinal location may correspond to a second radial location along the expandable block 416. In some embodiments, the first cutting element 417-1 and the second cutting element 417-2 may be adjacent cutting elements in the cutting profile 429. In some embodiments, the first cutting element 417-1 and the second cutting element 417-2 may be alternating cutting elements in the cutting profile such that one or more cutting elements 417 are positioned between the first cutting element 417-1 and the second cutting element 417-2.

In some embodiments, the expandable block 416 may include a first brake element 418-1 and a second brake element 418-2. The first brake element 418-1 may be positioned behind or underneath the first cutting element 417-1 and the second brake element 418-2 may be positioned behind or underneath the second cutting element 417-2. As discussed herein, the first cutting element 417-1 and the second cutting element 417-2 may wear, and the first brake element 418-1 and the second brake element 418-2 may each become exposed and engage the borehole wall. In this way, the first brake element 418-1 engaging the borehole wall may indicate wear of the expandable block 416 at the first longitudinal location of the cutting profile 429 and/or the first radial location along the expandable block 416. The second brake element 418-2 engaging the borehole wall may indicate wear of the expandable block 416 at the second longitudinal location of the cutting profile 429 and/or the second radial location along the expandable block 416. In this way, one or more brake elements 418 may be positioned behind, underneath, or radially inward of one or more engagement elements of the expandable block 416 to indicate various locations, degrees, and varieties of wear of the expandable tool.

FIG. 5 illustrates a flowchart of a method 540 or a series of acts for using the expandable underground tool as discussed herein, according to at least one embodiment of the present disclosure. While FIG. 5 illustrates acts according to one embodiment, alternative embodiments may omit, add to, reorder, and/or modify any of the acts shown in FIG. 5. The acts of FIG. 5 can be performed as part of a method.

The method 540 may include receiving drilling parameters at 541. For example, the drilling parameters may be received while performing a drilling operation with an expandable reamer. The drilling operation may include drilling, reaming, cutting casing, any other downhole drilling activity, and combinations thereof. The drilling parameters may include, but are not limited to weight (e.g., SWOB, WOB, WOR), torque (e.g., STOB, TOB, TOR), rate of penetration (ROP), or any combination thereof.

The method 540 may include evaluating whether a brake element has engaged a borehole wall. For example, the drilling parameters may be evaluated to determine whether a brake element has engaged with the borehole wall. The evaluation may be based on a comparison of one or more drilling parameters with thresholds. As discussed herein, the brake elements are arranged within the expandable reamer in a manner to affect one or more drilling parameters upon engagement with the borehole wall. For example, the WOR may increase more than 40% of the SWOB or 100% more than WOB. As another example, the TOR may decrease more than 10% of the STOR or more than 25% of the TOB. As another example, the ROP may decrease more than 25% of a threshold. In some embodiments, the engagement of the brake element with the borehole wall may affect multiple drilling parameters, such as a decrease in the ROP by 25% in combination with an increase in the WOR by more than 75% of the WOB, or a decrease in the ROP by 25% in combination with a decrease in the TOR more than 10% of the STOR. Engagement of the brake element with the borehole wall may correspond to a reduced diameter of the expandable reamer due to ringout of the expandable reamer.

The method 540 may include adjusting the drilling operation at 543. The adjustments to the drilling operation may include, but are not limited to recording the depth that corresponds to the determined engagement of the brake element with the borehole wall, transmitting the depth to the surface, stopping the drilling operation to pull the expandable reamer out of the borehole, or retracting the expandable reamer and extending another expandable reamer within the borehole. In some embodiments, the adjustment to the drilling operation may be to adjust a threshold for determining engagement of the brake element with the borehole. For adjustments to the drilling operation at 543 in which the bottom hole assembly remains within the borehole, the method may repeat as shown by arrow 544 for the same or different thresholds for evaluation of engagement of one or more brake elements with the borehole wall.

In some embodiments, the adjustment to the drilling operation at 543 may enable continued monitoring of drilling parameters to determine brake engagement, as shown by arrow 544. For example, the drilling parameters may be received at 541 and monitored to identify a second wear signal. For example, the brake element may be a first brake element and the expandable reamer may include a second brake element positioned at a different radius from the first brake element, as described herein. Upon repeating the method 540 after adjusting a drilling operation at 543, the method may include receiving the drilling parameters at 541 and evaluating at 542 whether the second brake element has engaged a borehole wall. If the drilling parameters do not indicate brake engagement with the borehole wall, then drilling parameters may continue to be received at 541 for later monitoring.

The evaluation at 542 may determine that the second brake element has engaged the borehole wall. For example, the second brake element engaging the borehole wall may result in one or more of an increase in WOR, a decrease in the TOR, a decrease in the ROP, or any combination thereof. The method 540 may include adjusting the drilling operation at 543 based on determining that the second brake element engaged the borehole wall. In this way, a second brake element may correspond to a second wear signal, which may indicate a wear (e.g., reduced diameter) of the expandable reamer to a further extent.

In some embodiments, the second brake element may be a brake element on a different or additional expandable reamer from the first brake element. For example, the adjustment to the drilling operation at 543 after determining the engagement of a first brake element with the borehole may be to activate the additional expandable reamer with the second brake element. Determining, that the second brake element has engaged the borehole wall may correspond to a level of wear of the additional expandable reamer. In this way, a second wear signal may further indicate the extent of wear on one or more expandable reamers of the drilling system. Adjustments to the drilling operation at 543 in response to evaluating a second wear signal at 542 may include, but are not limited to recording the depth that corresponds to the determined engagement of the second brake element with the borehole wall, transmitting the depth to the surface, or stopping the drilling operation to pull the expandable reamer out of the borehole.

The embodiments of the expandable downhole tool have been primarily described with reference to a wellbore drilling operation; the expandable downhole tool described herein may be used in applications other than the drilling of a wellbore. In other embodiments, the expandable downhole tool according to the present disclosure may be used outside a wellbore or other downhole environment used for the exploration or production of natural resources. For instance, the expandable downhole tool of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A reamer block, comprising:

a cutting element coupled to the reamer block, the cutting element comprising a cutting face extending to a gauge radius of the reamer block, the cutting element having a cutting rake angle formed on a radial plane of the reamer block between the cutting face and a normal line, the normal line being orthogonal to a borehole wall; and a brake element embedded in the reamer block at a first radial location, wherein the brake element is oriented such that it increases a weight on reamer (WOR), and wherein the WOR is detectable from a surface location.

2. The reamer block of claim 1, wherein the brake element comprises a brake rake angle that is greater than the cutting rake angle.

3. The reamer block of claim 1, wherein the cutting element has a cutting profile angle formed on a longitudinal plane of the reamer block between the cutting face and the normal line, and wherein the brake element has a brake profile angle that is different than the cutting profile angle, the brake profile angle being formed on the longitudinal plane of the reamer block between an engagement face and the normal line.

4. The reamer block of claim 3, wherein the brake profile angle is greater than the cutting profile angle.

5. The reamer block of claim 3, wherein the brake element is a first brake element having a first brake rake angle and a first brake profile angle, and wherein the reamer block further comprises a second brake element embedded in the reamer block located a longitudinal distance from the first brake element, the second brake element having a second brake rake angle and a second brake profile angle, and wherein the first brake rake angle and the second brake rake angle are greater than the cutting rake angle, and the first brake profile angle and the second brake profile angle being greater than the cutting profile angle.

6. The reamer block of claim 5, comprising: a plurality of cutting elements, the plurality of cutting elements defining a cutting profile, the cutting profile comprising:

a first portion extending a first profile radius, the first brake element being located within the first portion and extending a first brake radius that is less than the first profile radius; and a second portion extending a second profile radius, the second brake element being located within the second portion and extending a second brake radius that is less than the second profile radius.

7. The reamer block of claim 1, wherein the brake element further comprises an engagement face and the engagement face is formed from an ultrahard material.

8. The reamer block of claim 1, wherein the brake element is embedded in the reamer block such that the brake element does not extend past a cutting profile of the reamer block.

9. The reamer block of claim 1, wherein the first radial location corresponds to a first level of ringout of the reamer block.

10. The reamer block of claim 9, further comprising a second brake element embedded in the reamer block at a second radial location, wherein the second radial location is different from the first radial location, and wherein the second radial location corresponds to a second level of ringout of the reamer block.

11. The reamer block of claim 2, wherein the brake rake angle is different from the cutting rake angle by at least 45°, the brake rake angle being formed on the radial plane of the reamer block between an engagement face and the normal line.

* * * * *